US007475944B2

(12) United States Patent
Griepentrog et al.

(10) Patent No.: US 7,475,944 B2
(45) Date of Patent: Jan. 13, 2009

(54) RECLINING AND CONVERTIBLE SEATING FURNITURE WITH TRENDELENBURG FEATURE

(75) Inventors: Dennis G. Griepentrog, DePere, WI (US); Scott J. Williams, Green Bay, WI (US); James E. Barefoot, Winston Salem, NC (US)

(73) Assignee: Krueger International, Inc., Green Bay, WI (US)

( * ) Notice: Subject to any disclaimer, the term of this patent is extended or adjusted under 35 U.S.C. 154(b) by 0 days.

(21) Appl. No.: 11/355,359

(22) Filed: Feb. 16, 2006

(65) Prior Publication Data

US 2006/0186718 A1 Aug. 24, 2006

Related U.S. Application Data

(60) Provisional application No. 60/654,124, filed on Feb. 18, 2005.

(51) Int. Cl.
*B60N 2/00* (2006.01)
*A47C 1/02* (2006.01)

(52) U.S. Cl. ..... 297/354.13; 297/84; 297/85; 297/328; 297/342

(58) Field of Classification Search ..... 297/354.13, 297/84, 85, 328, 342
See application file for complete search history.

(56) References Cited

U.S. PATENT DOCUMENTS 3,833,257 A * 9/1974 Dove ..... 297/284.1
4,722,566 A 2/1988 Castellini
4,858,260 A 8/1989 Failor et al.
5,007,679 A 4/1991 Mizelle
5,056,862 A 10/1991 May et al.
5,086,769 A 2/1992 Vianello et al.
5,271,660 A 12/1993 LaPointe et al.
5,277,080 A 1/1994 Roelle
5,340,191 A 8/1994 May
5,348,367 A 9/1994 Mizelle
5,419,616 A * 5/1995 Paetzold ..... 297/378.12
5,547,245 A * 8/1996 Knouse ..... 297/85
5,567,001 A 10/1996 Zalewski
5,758,544 A * 6/1998 Lee ..... 74/483 R
5,845,961 A 12/1998 LaPointe et al.
5,865,457 A 2/1999 Knabusch et al.
5,890,765 A 4/1999 LaPointe et al.
5,931,535 A 8/1999 Sweet
6,089,593 A 7/2000 Hanson et al.

(Continued)

*Primary Examiner*—Sarah B McPartlin
(74) *Attorney, Agent, or Firm*—Boyle Fredrickson, S.C.

(57) ABSTRACT

An article of seating furniture includes a base, a seat and a back. The back includes a reclining mechanism. The seat is interconnected with the reclining mechanism such that reclining movement of the back moves the seat forwardly and upwardly. When the back is fully reclined and the seat is fully raised, an upper surface of the seat is coplanar with an upper surface of the back. A footrest is movable between a retracted position and an extended position. When extended, the footrest is generally coplanar with the seat. The back includes a spine having a lower end pivotably interconnected with the base. The spine includes a seat mounting extension to which the seat is pivotably mounted. Mounting links between the seat and the base provide movement of the seat when the back is reclined. The base is pivotably mounted to a frame for movement between a horizontal orientation and a Trendelenburg orientation in which the back is lowered relative to the seat, and a latch between the frame and the base maintains the base in the desired orientation.

21 Claims, 15 Drawing Sheets

U.S. PATENT DOCUMENTS

| | | | | |
|---|---|---|---|---|
| 6,227,489 | B1 | 5/2001 | Kitamoto et al. | |
| 6,315,319 | B1 | 11/2001 | Hanson et al. | |
| 6,336,235 | B1 | 1/2002 | Ruehl | |
| 6,390,546 | B1 | 5/2002 | Ming | |
| 6,390,554 | B1 | 5/2002 | Eakins et al. | |
| 6,460,930 | B2 | 10/2002 | Thornton | |
| 6,565,112 | B2 | 5/2003 | Hanson et al. | |
| 6,644,733 | B1 | 11/2003 | Tseng | |
| 6,679,556 | B1 | 1/2004 | Alvestad | |
| 6,846,042 | B2 * | 1/2005 | Hanson et al. | 297/411.36 |
| 6,855,098 | B2 | 2/2005 | Reitz et al. | |
| 6,880,482 | B2 | 4/2005 | Huse | |
| 6,883,458 | B2 | 4/2005 | Huse | |
| 2002/0014751 | A1 | 2/2002 | Hanson et al. | |
| 2003/0079289 | A1 | 5/2003 | Vrzalik | |
| 2004/0195798 | A1 | 10/2004 | Newfer et al. | |
| 2005/0104420 | A1 | 5/2005 | Murphy | |

* cited by examiner

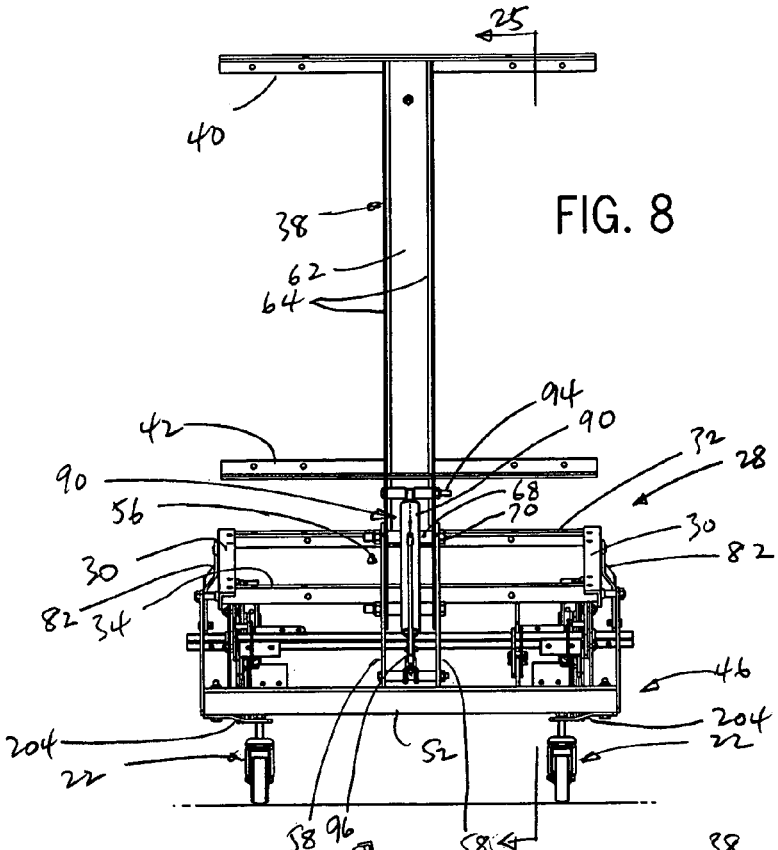
FIG. 8
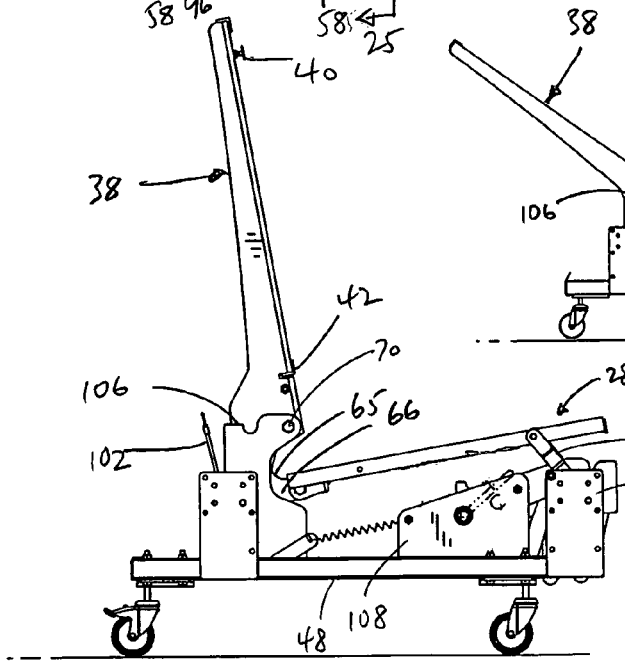
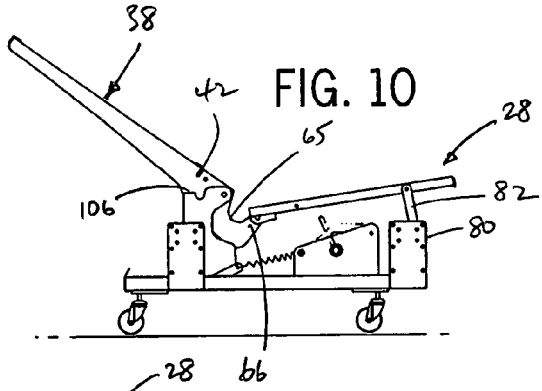
FIG. 10
FIG. 9

RECLINING AND CONVERTIBLE SEATING FURNITURE WITH TRENDELENBURG FEATURE

CROSS-REFERENCE TO RELATED APPLICATION

This application claims the benefit of U.S. Provisional Application Ser. No. 60/654,124, filed Feb. 18, 2005.

BACKGROUND OF THE INVENTION

This invention relates to seating furniture, and more particularly to seating furniture such as a chair, which incorporates certain movable components that can be moved to different positions according to user requirements.

A conventional reclining chair typically includes a base in combination with a seat and a back, which are interconnected with the base. The back is mounted to the base for reclining movement. The seat is typically mounted in a fixed position relative to the base. The article of furniture may include an extendible and retractable footrest, which may be movable to varying positions by operation of an actuating handle that controls operation of a ratchet-type actuator for positioning the footrest in varying angular positions.

It is an object of the present invention to provide an article of furniture, such as a chair, in which the seat and the back can be positioned in a coplanar, upwardly facing configuration, in which the seat and the back are positioned generally horizontally so that the seating furniture can be converted to a sleeping configuration. It is a further object of the invention to provide an article of seating furniture which includes a back reclining arrangement that enables the back to be moved to varying angular positions, and which provides synchronous raising of the seat when the back is lowered, and synchronous lowering of the seat with the back is raised. It is another object of the invention to provide an article of seating furniture which incorporates a unique frame configuration for providing reclining movement of the back and for synchronously moving the seat with the back. Yet another object of the invention is to provide an article of seating furniture which includes a footrest that can be moved between extended and retracted positions, and which can be selectively maintained in one or more intermediate positions between the extended and retracted positions. Yet another object of the invention is to provide an article of seating furniture in which a footrest positioning mechanism provides positive positioning of the footrest in predetermined angular orientations relative to the seat, and which is relatively simple in its components, construction and operation. Yet another object of the invention is to provide an article of seating furniture which can be converted to a bed configuration in which the seat and the back are generally coplanar, and which can be moved to a Trendelenburg position in which the head area of the back is below the foot area of the seat. A still further object of the invention is to provide an article of seating furniture incorporating a uniquely configured actuator for providing selective operation of certain movable components of the article of seating furniture, such as the reclining back mounting mechanism and the Trendelenburg feature. Yet another object of the invention is to provide an article of seating furniture in which the actuator provides a flush mount construction, so as not to have protruding components and not to detract from the overall aesthetic appearance of the article of seating furniture.

SUMMARY OF THE INVENTION

In accordance with a first aspect, the present invention contemplates an article of furniture, such as a chair, which includes a base in combination with a seat and a back mounted to the base. The back is mounted to the base via a reclining arrangement, which enables the back to be moved between an upright position and a reclined position. The seat is movably mounted to the base, and is interconnected with the back reclining arrangement such that rearward reclining movement of the back causes forward and upward movement of the seat. The back is movable to an upwardly facing, generally horizontal fully reclined position. When the back is in the fully reclined position, the seat is moved to a generally horizontal, raised position in which the seat and the back define substantially coplanar upwardly facing horizontal surfaces. In this manner, the article of furniture can be converted between an upright position for seating and a fully reclined position in which the article of furniture can be used as a bed.

The article of furniture further includes a footrest arrangement interconnected with the base for movement between a retracted or lowered position and an extended or raised position. When the footrest is in the extended or raised position, the footrest defines an upwardly facing surface that is generally horizontal and coplanar with the upwardly facing surfaces of the seat and back when the back is in the fully reclined position.

In a representative embodiment, the article of furniture includes a frame having a spine to which the back is mounted, and which defines a lower end that is pivotably mounted to the base for moving the back between the upright position and the reclined position. The seat is interconnected with the base via one or more front mounting links, which provide upward and forward movement of the seat when the back is reclined.

In accordance with another aspect, the present invention contemplates a Trendelenburg feature for an article of seating furniture, such as a chair, which includes a base to which a seat and back are mounted. Representatively, the seat and back may be mounted to the base as described above, for movement between a seating configuration and a reclined configuration in which the seat and the back can function as a bed. This aspect of the invention contemplates a frame adapted for engagement with a support surface such as a floor. The base is pivotably mounted to the frame for movement between a first position in which the seat and back are in a generally horizontal configuration, and a second position in which the seat and back are pivoted to a Trendelenburg position in which the head area of the back is lowered relative to the seat. A latch arrangement is interposed between the frame and the base, for selectively maintaining the base in either the first position or the second position. The latch arrangement may be in the form of one or more latch members defining an upper detent area and a lower detent area. A retainer member, which may be in the form of a retainer pin, is selectively engaged within the lower detent area for maintaining the base in the first position, and within the upper detent area for maintaining the base in the second position. The retainer pin is movable to a release position, in which the retainer pin can be disengaged from the upper and lower detent areas, by operation of one or more cable-type actuators which are configured to move the retainer pin from the latching position to the release position. The retainer pin is biased toward the latching position, and is movable away from the latching position toward the release position by operation of the one or more cable-type actuators. In a preferred form, a pair of cable-type actuators are mounted to the article of furniture in spaced locations, and either actuator can be employed to move the retainer pin between the latching and release positions for moving the base between the first and second positions relative to the frame. The latch arrangement includes a biased actuating mechanism interposed between the cables of the cable-type actuators and the retainer pin, for providing movement of the retainer pin between the latching position and the release position in response to operation of either of the cable-type actuators. The one or more latch members may be in the form of a pair of spaced apart latch members, which define aligned upper retainer notches and aligned lower retainer notches, within which the retainer pin is selectively engaged. The latch members define guide surfaces between the upper and lower notches, which guide movement of the retainer pin as the retainer pin is moved between the upper and lower retainer notches.

In accordance with another aspect, the present invention contemplates an extendible and retractable footrest operating or positioning mechanism for use with an article of seating furniture which includes a base. The footrest positioning mechanism is operable to selectively fix the position of a footrest assembly that includes a footrest member and an extension and retraction mechanism interconnected between the footrest member and the base. The extension and retraction mechanism is configured to provide selective outward and inward movement of the footrest relative to the base. The footrest positioning mechanism includes a footrest actuator interconnected with the extension and retraction mechanism, for selectively operating the extension and retraction mechanism for moving the footrest. Representatively, the extension and retraction mechanism may be in the form of a pair of extendible and retractable linkages that are mounted to the base, and the footrest member may be connected between the outer ends of the linkages. The footrest actuator may be in the form of a rotatable actuator bar interconnected with the base and with the linkages. The actuator bar is interconnected with the linkages such that rotation of the actuator bar, such as by operation of a user-operated handle, functions to move the linkages between the extended and retracted positions. The footrest positioning mechanism further includes a retainer arrangement for selectively maintaining the footrest in a selected extended position relative to the base. The retainer arrangement includes a retainer member interconnected with the base and defining one or more engagement areas. The footrest positioning mechanism further includes a movable latch member that is interconnected with the footrest actuator for movement along with the footrest actuator. The latch member is selectively engaged with one of the engagement areas of the retainer member upon extension of the extension and retraction mechanism, to selectively provide a desired angular orientation relative to the base. The retainer member preferably includes two or more engagement areas, such as an intermediate engagement area for positioning the footrest member in an intermediate extended position, and an upper engagement area for positioning the footrest member in a fully raised position. The latch member may be in the form of a latch pin, which is interconnected with the footrest actuator by a slotted operating member. The latch pin is received within a slot in the operating member, to enable movement of the latch pin into engagement with the engagement areas of the retainer member and movement of the latch pin along the surfaces of the retainer member between the engagement areas, as the extension and retraction mechanism is extended so as to extend the footrest member. The latch pin is movable into a disengagement area of the slot when the actuator is rotated and when the extension and retraction mechanism is fully extended. In the disengagement area of the slot, the latch pin is movable so as to be maintained out of engagement with the engagement areas of the retainer member, which enables the actuator to be rotated in the opposite direction so as to retract the extension and retraction mechanism, and to thereby lower the footrest, upon rotation of the footrest actuator in the opposite direction. Representatively, the retainer member may include a cam surface that is operable to move the latch pin into the disengagement area of the slot upon rotation of the footrest actuator. As the extension and retraction mechanism approaches the fully retracted position, in which the footrest member is fully lowered and retracted, the latch pin is moved out of the disengagement area of the slot and is returned to the engagement area of the slot, which enables the latch pin to be biased against the surface and engagement areas of the retainer member. Representatively, the latch pin may be returned to the engagement area of the slot by operation of a cam surface associated with the retainer member, which is operable to move the latch pin out of the disengagement area of the slot and into the engagement area of the slot.

In accordance with another aspect, the present invention contemplates a cable-type actuator, such as for use in an article of furniture to control operation of certain components of the article of furniture. The actuator includes a housing defining a recess, in combination with a pull member that partially overlies the recess. An actuator cable is connected to the housing, and includes a movable end that is secured to the pull member. The pull member is pivotably mounted to the housing, and is movable in response to the application of an outward force to an inner surface of the pull member from within the housing recess, such that outward movement of the pull member applies tension to the cable. The housing defines a peripheral rim, and the pull member extends between spaced apart areas of the rim. Representatively, the pull member may be pivotably mounted to the housing by means of a pivot pin. The pull member defines an external surface that is generally flush with the peripheral rim of the housing, to provide a flush configuration for the actuator when the actuator housing is received within a recess in the article of furniture.

The features and aspects of the present invention can be separately incorporated into an article of furniture, and each has distinct advantages that enhance the construction and/or operation of the article of furniture. The features of the present invention can also be employed in various combinations and subcombinations, or all together, to further enhance the construction and/or operation of the article of furniture.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 8 is a rear elevation view of the frame and internal components of the chair as illustrated in FIG. 7;

FIG. 9 is a side elevation view of the frame and internal components of the chair of FIGS. 6-8, in a position corresponding to the upright position of the chair as in FIG. 1;

FIG. 10 is a view similar to FIG. 9, showing the frame and internal components of the chair in a partially reclined position;

DETAILED DESCRIPTION OF THE INVENTION

Figure 1:
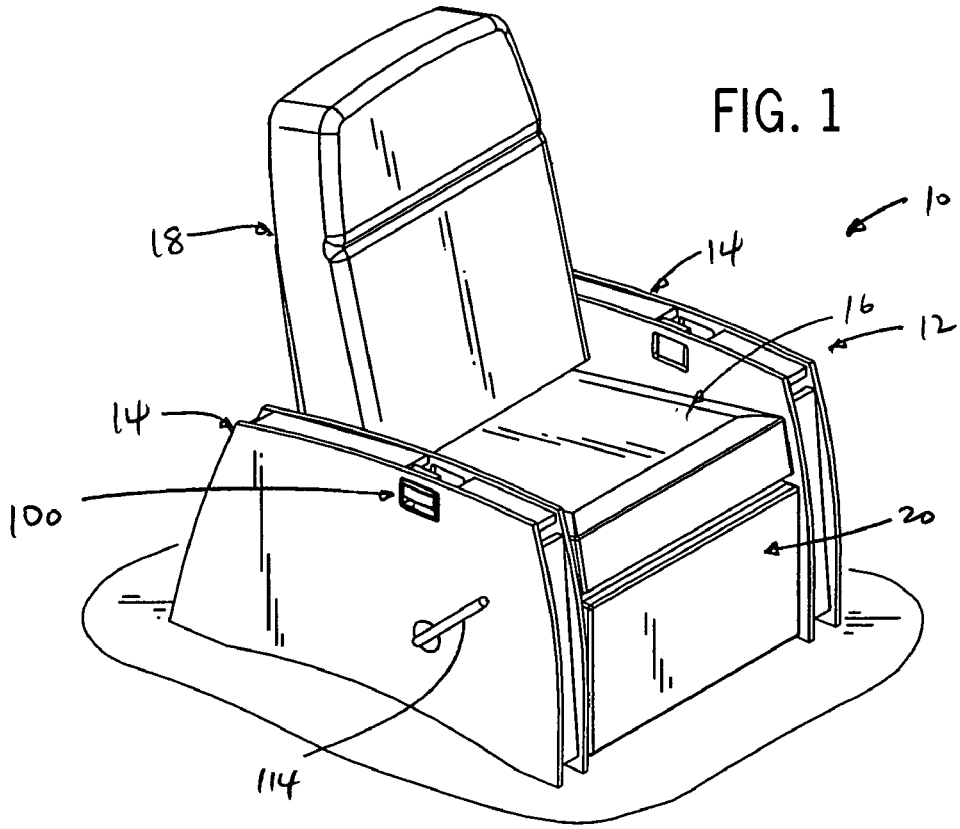
FIG. 1 is an isometric view of a convertible and reclining article of furniture, in the form of a chair, incorporating the features of the present invention, in which the chair is illustrated in an upright position.

Referring to FIGS. 1-4, an article of seating furniture, shown in the form of a chair 10, incorporates the features of the present invention. Chair 10 generally includes a base 12 having a pair of upright, spaced apart arms 14, in combination with a seat 16 and a back 18 which are mounted to base 12 for movement between arms 14, in a manner to be explained. A footrest 20 is movably mounted to base 12 below seat 16, also in a manner to be explained.

In the illustrated embodiment, the article of seating furniture is illustrated as a chair. It is understood, however, that the article of furniture may have a width greater than that associated with a typical chair, for providing multiple seating as in a loveseat or sofa.

Figure 11:
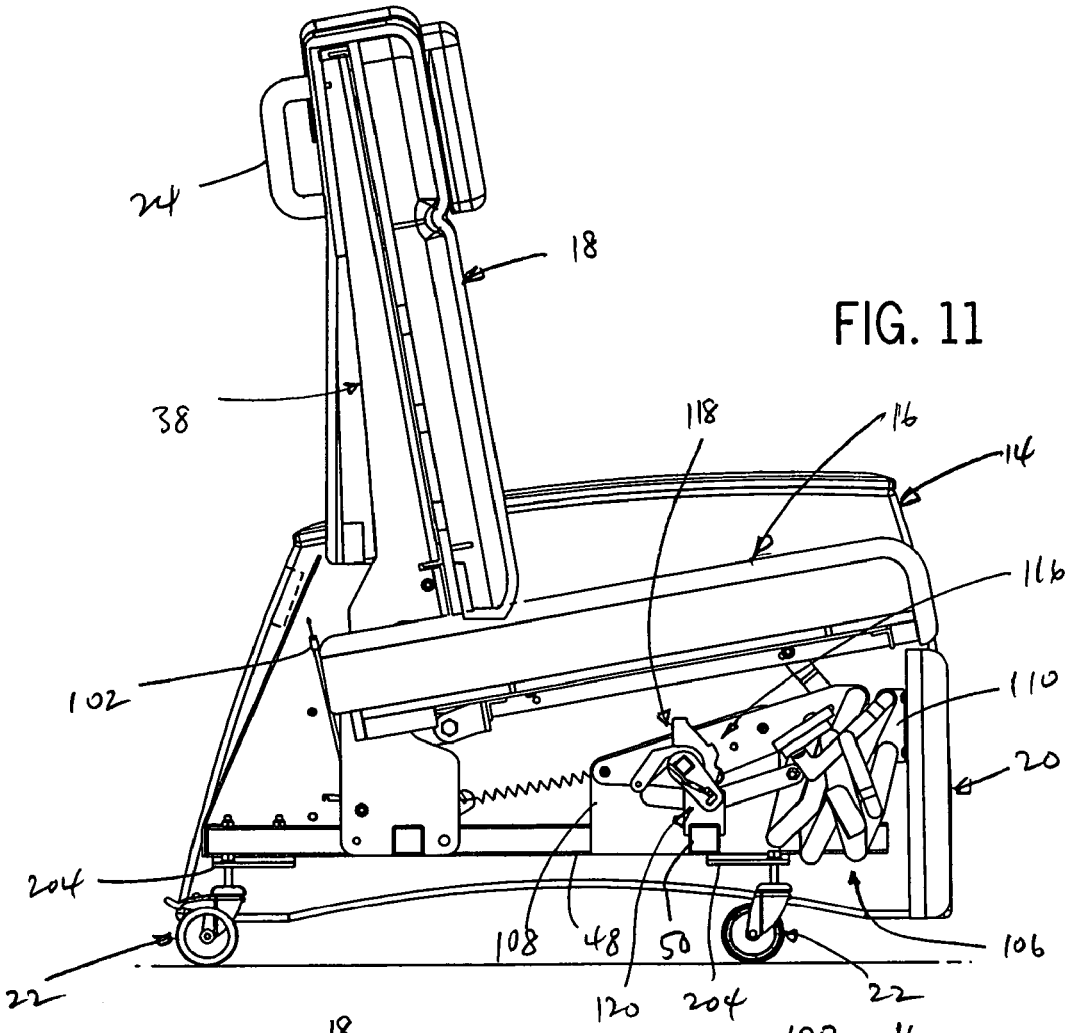
FIG. 11 is a section view taken along line 11-11 of FIG. 3.
Figure 12:
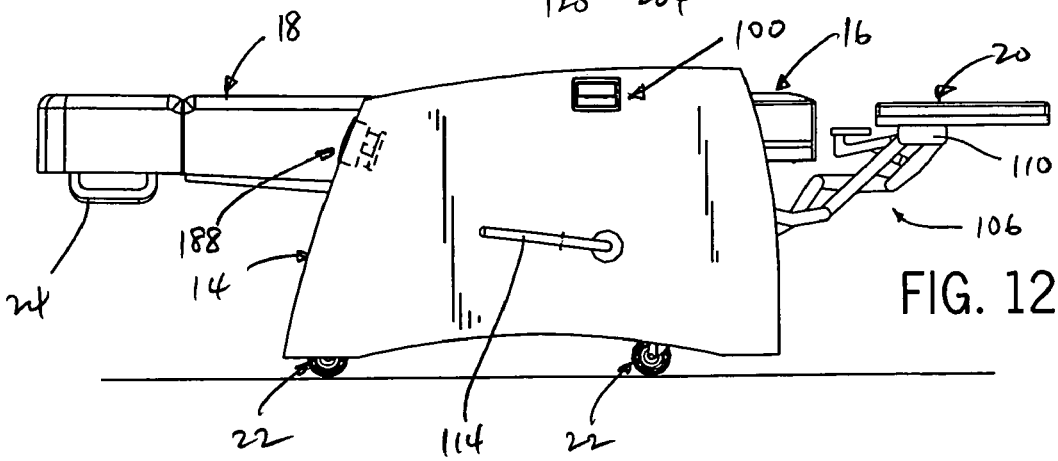
FIG. 12 is a side elevation view of the chair of the present invention, showing the chair in a fully reclined position as in FIG. 2.

In one embodiment, base 12 includes a series of casters 22 (FIGS. 3, 4) that enable chair 10 to be moved to various locations within a room. As shown in FIG. 11, the upper portion of back 18 includes a pair of handles 24 that can be grasped by a user to assist in moving chair 10.

Figure 2:
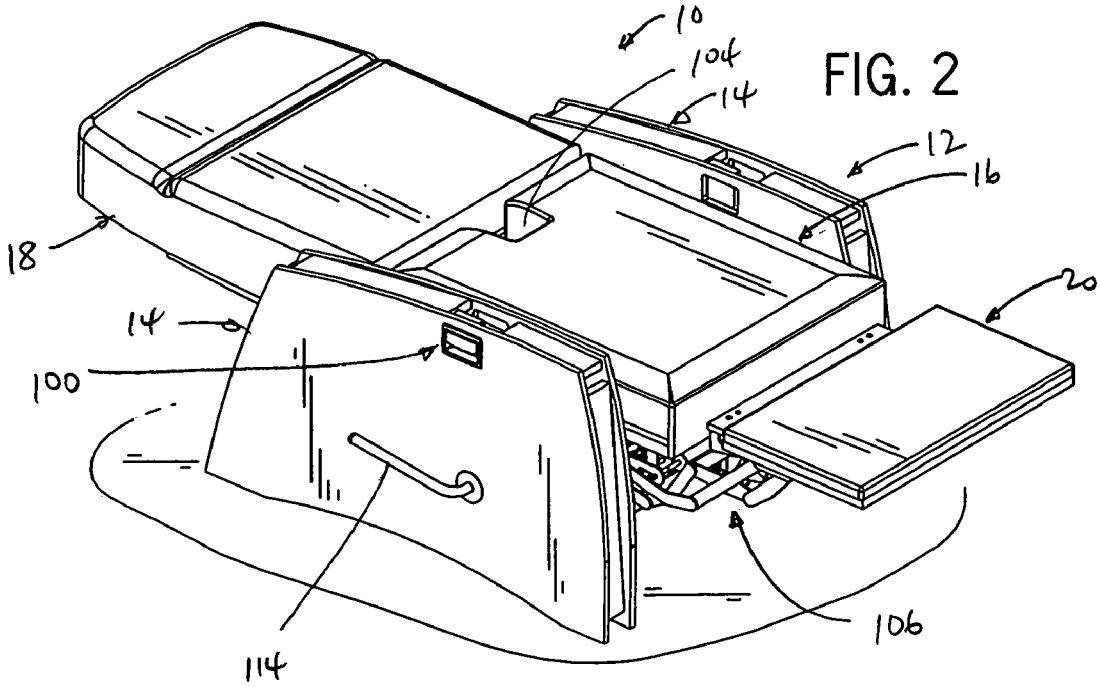
FIG. 2 is a view similar to FIG. 1, showing the chair in a fully reclined position, in which the chair can be used as a bed.

Back 18 of chair 10 is movable throughout a range of positions, between an upright position as shown in FIG. 1, in which back 18 extends upwardly in an orientation nearly perpendicular to seat 16, throughout an infinite range of angular, reclined positions to a flat position as shown in FIG. 2, in which the front surface of back 18 faces upwardly and is coplanar with the upwardly facing surface of seat 16. In this manner, chair 10 can function both as seating furniture in the upright or angularly reclined positions of back 18, and as a bed when back 18 is in the fully reclined or flat position. When back 18 is in the fully reclined or flat position, both seat 16 and back 18 are in a generally horizontal orientation, to provide a sleeper function for chair 10.

Footrest 20 can be placed in a number of different positions, between a lowered and retracted position as shown in FIG. 1, in which the support surface of footrest 20 is positioned inwardly and vertically, to a number of angled positions to provide different angles of the support surface of footrest 20. Footrest 20 can also be placed in a fully extended and raised position as shown in FIG. 2, in which the support surface of footrest 20 is coplanar with the upwardly facing surface of seat 16. When back 18 is placed in the fully reclined or flat position so as to be coplanar with seat 16, footrest 20 is typically in the fully raised position as in FIG. 2 so as to provide support for a user's feet when chair 10 is used as a sleeper or bed.

In addition, in a manner to be explained, seat 16, back 18 and footrest 20 can be moved relative to base 12 to a Trendelenburg position, in which the coplanar surfaces of seat 16, back 18 and footrest 20 are at a predetermined reverse angle relative to horizontal, e.g. at an angle of approximately 10°, so that back 18 is at a lower elevation than seat 16 and footrest 20.

In a manner to be explained, seat 16 shifts forwardly relative to base 12 during rearward reclining motion of back 18, which functions to stabilize chair 10 against tipping when chair 10 is used as a sleeper or bed.

Referring to FIGS. 5-8, seat 16 of chair 10 is mounted to an internal frame 28, which includes a pair of side frame members 30, a front frame member 32 and a rear frame member 34. Back 18 is mounted to an axially extending support spine 38 via an upper back mounting member 40 and a lower back mounting member 42. Spine 38 cooperates with upper and lower back mounting members 40, 42, respectively, to form an I-shaped support for back 18.

Base 12 of chair 10 includes a base frame 46 having a pair of side frame members 48, a front frame member 50 and a rear frame member 52. Base frame 46 further includes an intermediate cross member 54, to which a main support 56 is mounted. Main support 56 is in the form of a pair of upwardly extending, spaced apart support plates 58 that are secured to intermediate cross member 54 in any satisfactory manner, such as by welding. It is understood that this construction of main support 56, as well as base frame 46, is representative of any number of satisfactory configurations that are possible for supporting seat frame 26 and spine 38.

Spine 38 has a channel-shaped cross section, defined by a front wall 62 and a pair of rearwardly extending sidewalls 64. Sidewalls 64 are formed so as to have an increasing depth toward the lower end of spine 38, defining a maximum depth adjacent main support 56. As shown in FIGS. 9 and 10, spine sidewalls 64 are formed with recesses 65 below the area of maximum depth, which define seat mounting arms 66, each of which is located adjacent one of support plates 58.

As shown in FIG. 8, spine 38 includes a transverse mounting bushing or sleeve 68 above seat mounting arms 66, which extends between and is interconnected at its ends with spine sidewalls 64. A back pivot member 70, which may be in the form of a pin, bolt or the like, extends through aligned openings in support plates 58 and through mounting sleeve 68, for pivotably mounting spine 38 to main support 56 for movement about a horizontal pivot axis defined by pivot member 70.

Figure 13:
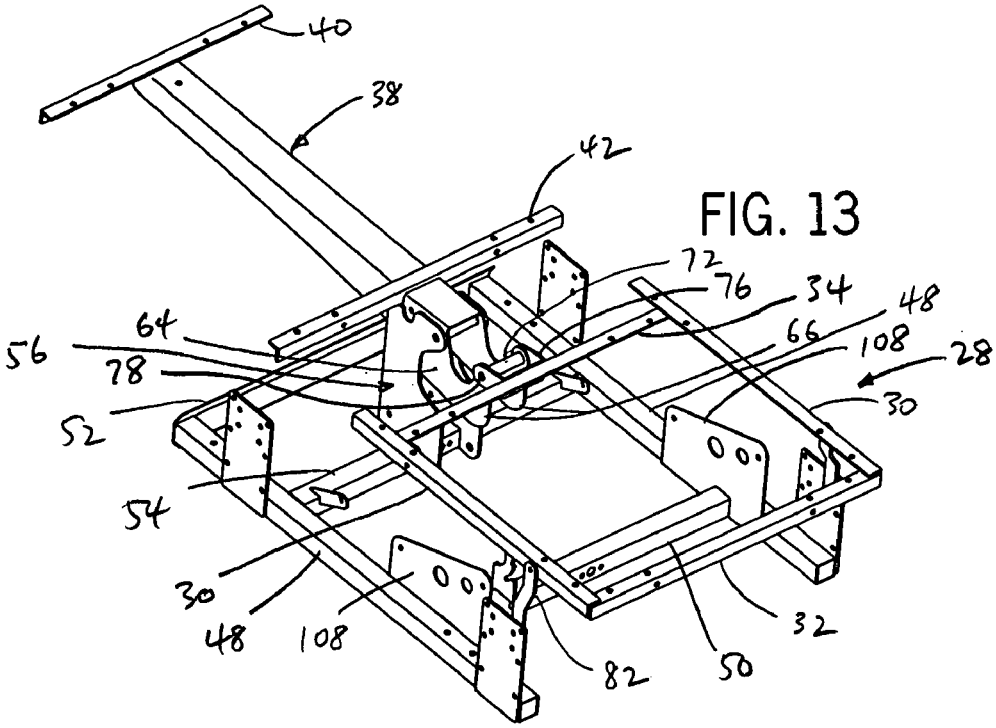
FIG. 13 is an isometric view of the frame and internal components of the chair similar to FIG. 6, corresponding to the fully reclined position of the chair as in FIG. 12.
Figure 14:
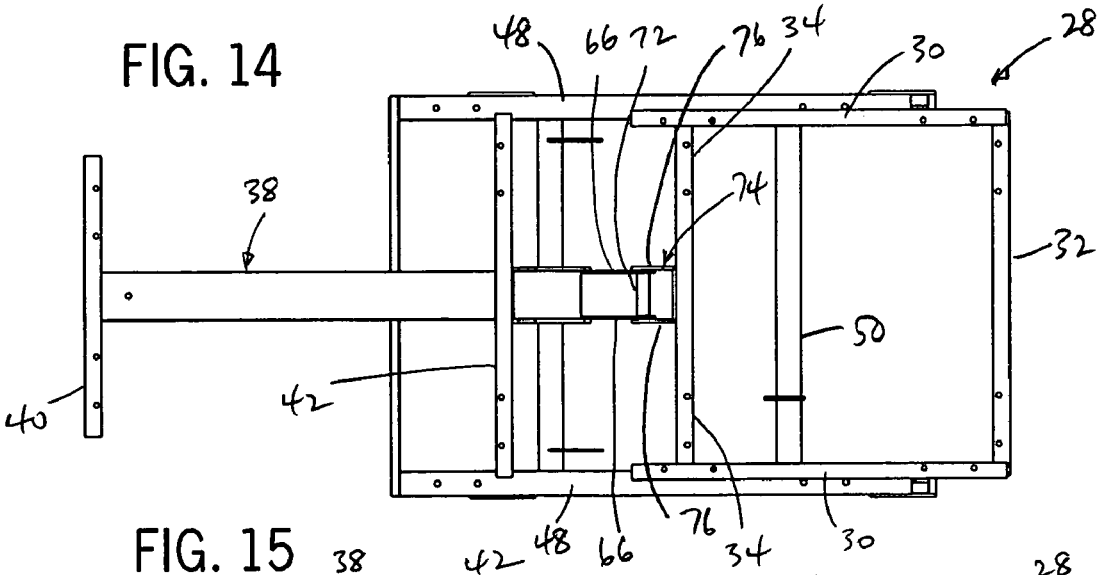
FIG. 14 is a top plan view of the frame and internal components of the chair shown in the fully reclined position of FIG. 13.

Referring to FIGS. 13 and 14, a mounting bushing or sleeve 72 extends between and is secured to the ends of seat mounting arms 66 formed by spine sidewalls 64. A seat mounting bracket 74 is mounted to rear frame member 34 of seat frame 28, and includes a pair of spaced apart seat mounting ears 76. A seat pivot member 78, which may be in the form of a bolt, pin or the like, extends through aligned openings in seat mounting ears 76 and through mounting sleeve 72, to pivotably mount the rear end of seat frame 28 to the lower end of spine 38 for movement about a horizontal pivot axis defined by seat pivot member 78. The pivot axes defined by pivot members 70, 78 are parallel and are oriented such that, when spine 38 is in its upright position, the seat pivot axis defined by seat pivot member 78 is in alignment with the back pivot axis defined by back pivot member 70, in a direction along the longitudinal axis of spine 38.

As shown in FIGS. 6-10, base 12 further includes a pair of upwardly extending front seat supports 80, which extend vertically upwardly from the front end of base frame 46. Seat frame 28 is mounted to seat supports 80 via a pair of seat support links 82. Each seat support link 82 is pivotably mounted at its lower end to one of seat supports 80 via a mounting member 84 defining a lower pivot axis, and is pivotably mounted at its upper end to one of seat side frame members 30 via an upper mounting member 86 defining an upper pivot axis.

With the above-described configuration, seat 16 is synchronously moved forwardly and upwardly as back 18 is reclined. Such movement of seat 16 is caused by the upward and forward movement of the rear of seat frame 22 through the pivot connection between seat mounting arms 66 and seat mounting bracket 74 as back 18 is reclined. The upward and forward movement of the rear of seat frame 28 results in forward pivoting movement of seat support links 82, which causes the front of seat frame 28 to move forwardly and slightly upwardly as the rear of seat frame 28 is moved forwardly and upwardly by seat support arms 66.

Back 18 can be secured in any desired angular reclined position relative to base 12, to fix seat 16 and back 18 in a position as selected by a user. In order to selectively maintain back 18 and seat 16 in position, an extendible and retractable gas cylinder assembly, shown generally at 90 (FIGS. 7, 8 and 16), is interconnected between base 12 and spine 38. Gas cylinder assembly 90 includes a cylinder 92 that is fixed at its upper end to a cross pin 94, which extends between and is connected to sidewalls 64 of spine 38, in combination with an extendible and retractable rod 96. A cross member 98 extends between lower extensions 99 associated with support plates 58, and the end of cylinder rod 96 is pivotably secured to cross member 98. A recline actuator 100 (FIGS. 1, 2) is mounted to each arm 14, and is interconnected with cylinder assembly 90 via an actuator cable 102, as shown in FIGS. 7-9 and 16. Details of the construction and operation of recline actuator 100 will later be explained. Operation of recline actuator 100 functions to control actuation of an actuator button at the end of cylinder rod 96 through actuator cable 102, in a manner as is known, so as to selectively allow extension and retraction of gas cylinder assembly 90. When a pull member of recline actuator 100 is actuated, actuator cable 102 functions to depress the actuator button of gas cylinder assembly 90 so as to enable cylinder rod 96 to extend and retract. When the pull member of recline actuator 100 is released, actuator cable 102 releases depression of the actuator button so as to prevent extension or retraction of cylinder rod 96, to maintain the effective length of gas cylinder assembly 90 so as to fix back 18, and thereby seat 16, in position relative to base 12. In a manner as is known, gas cylinder assembly 90 includes an internal spring that applies an outward bias on cylinder rod 96, so as to urge gas cylinder assembly 90 to an extended condition that tends to urge back 18 toward its upright position. When recline actuator 100 is actuated, the user applies a rearward force to back 18, which overcomes the bias of gas cylinder assembly 90 and thereby shortens the overall length of gas cylinder assembly 90 when back 18 is reclined.

As shown in FIG. 2, the cushion of seat 16 includes a recess, shown at 104, within which spine 38 is received when back 18 is in any of the selected non-horizontal positions.

As illustrated in FIGS. 1 and 2, when back 18 is reclined, the forward shifting of seat 16 relative to base 12 functions to shift the overall center of gravity of the combination of seat 16 and back 18 forwardly relative to base 12. In this manner, when back 18 is fully reclined to the flat position, the forward shift in the center of gravity of seat 16 and back 18 relative to base 12 functions to enhance the overall stability of the sleeper or bed that is formed when back 18 is fully reclined. A user can be supported on the reclined back 18 without tipping chair 10, even when sitting at the end of the upwardly facing back 18.

In addition, when back 18 is fully reclined and seat 16 is moved forwardly and upwardly, the plane defined by the upper surfaces of seat 16 and back 18 is located only slightly below the tops of arms 14. With this configuration, when chair 10 is employed as a sleeper or bed, it is not difficult for a user to exit the sleeper or bed to the side, over the top of one or the other of the arms 14.

Figure 15:
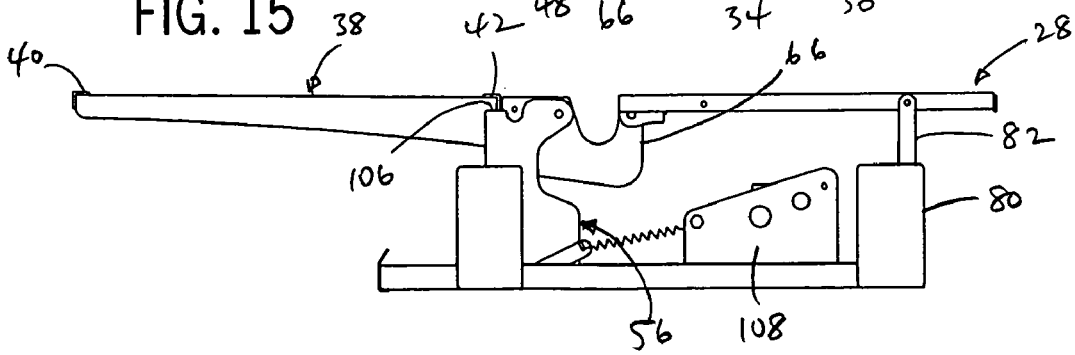
FIG. 15 is a side elevation view similar to FIGS. 9 and 10, showing the frame and internal components of the chair corresponding to the fully reclined position of FIGS. 13 and 14.
Figure 16:
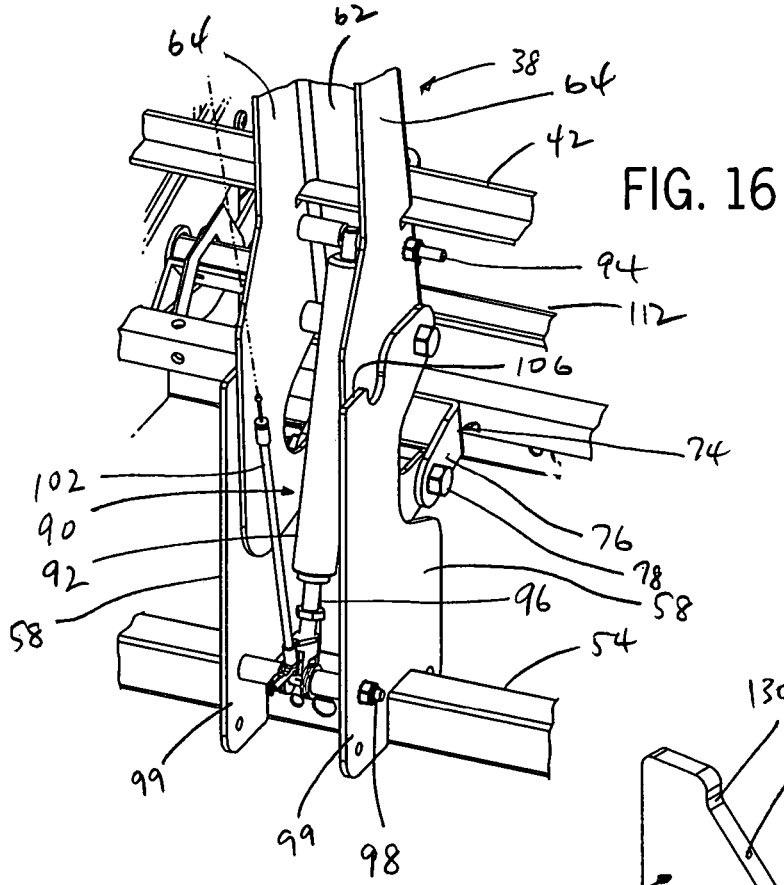
FIG. 16 is an enlarged partial isometric view with reference to line 16-16 of FIG. 7.
Figure 17:
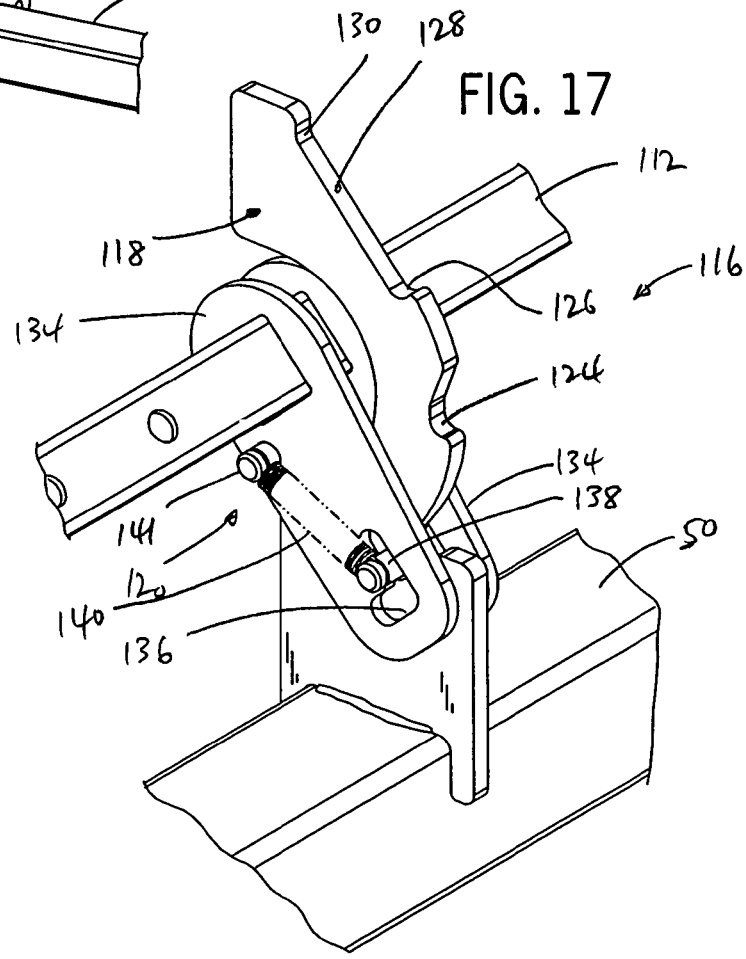
FIG. 17 is an enlarged partial isometric view with reference to line 17-17 of FIG. 7, showing a footrest positioning mechanism incorporated into the chair of FIG. 1.
Figure 19:
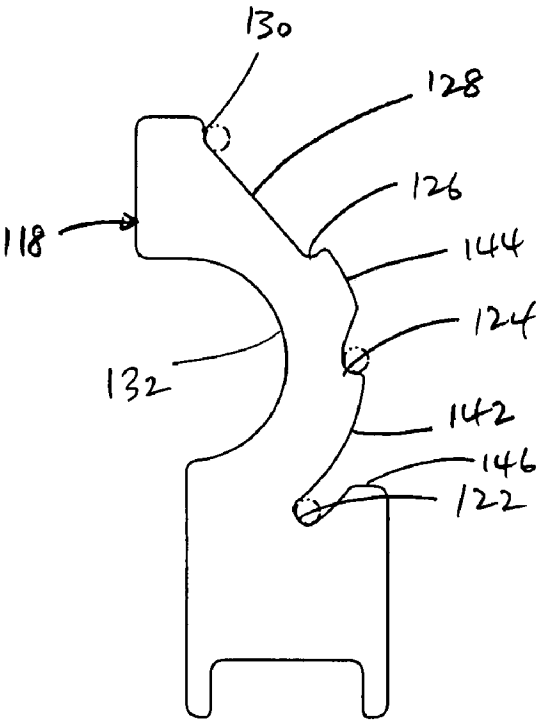
FIG. 19 is a side elevation view of a cam surface member incorporated in the footrest positioning mechanism of FIG. 18.
Figure 18:
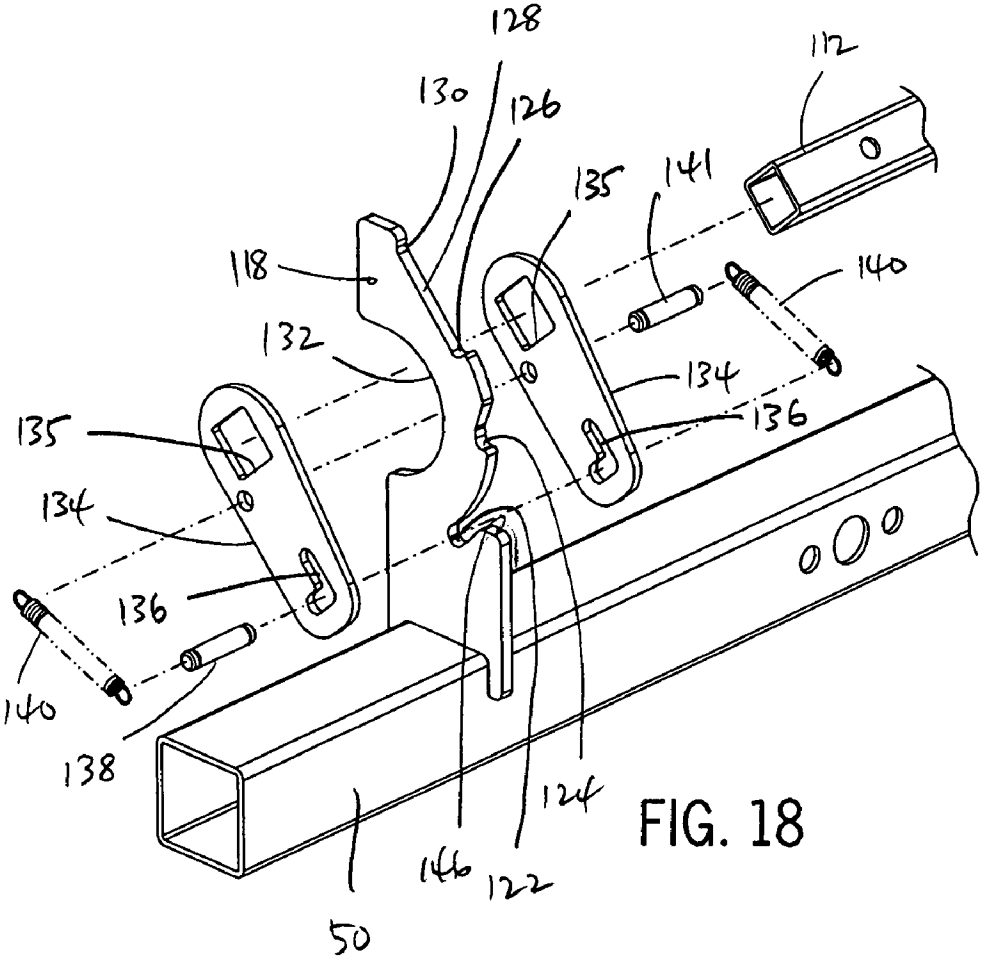
FIG. 18 is an exploded isometric view of the footrest positioning mechanism of FIG. 17.

Referring to FIGS. 9, 10 and 15, in order to provide a positive stop for positioning back 18 in the flat or horizontal position, support plates 58 are provided with upwardly facing stop surfaces 106, which are engaged by lower back mounting member 42 when spine 38 is positioned horizontally. It can be appreciated that, when spine 38 is positioned horizontally, the geometry of seat frame 28 and the mounting components for seat frame 28 is such that seat frame 28 is also positioned horizontally so that the upper surfaces of seat 16 and back 18 are coplanar. It should be understood that the illustrated stop arrangement is representative of numerous different stop constructions that may be employed for positioning back 18 in a horizontal position.

As shown in FIGS. 2 and 11, footrest 20 is connected to base 12 via a pair of conventional linkage-type footrest extension and retraction mechanisms 106. The inner ends of footrest extension and retraction mechanisms 106 are mounted to a pair of footrest mounting plates 108, each of which is secured to one of base side frame members 48. The outer ends of footrest extension and retraction mechanisms 106 include outer mounting brackets 110, to which footrest 20 is secured.

Footrest extension and retraction mechanisms 106 are responsive to rotational movement of a transversely extending actuator bar 112 which, in the illustrated embodiment, has a square cross-section. One end of actuator bar 112 is secured to an operating handle 114, which is positioned outwardly of one of arms 14 in a position that is readily accessible by a user. Counterclockwise rotation of actuator bar 112 by application of an upward and rearward force on handle 114 by a user causes footrest extension and retraction mechanism 106 to extend so as to move footrest 20 upwardly and outwardly. Conversely, clockwise rotation of actuator bar 112 by application of a downward and forward force on handle 114 causes footrest extension and retraction mechanisms 106 to retract, to move footrest 20 downwardly and inwardly.

As shown in FIGS. 11 and 17-22, a footrest positioning mechanism, shown generally at 116, is interconnected with base 12 and footrest actuator bar 112, for maintaining footrest 20 in one of a series of predetermined angular positions. Footrest positioning mechanism 116 includes a cam-type retainer plate 118 that is mounted at its lower end to front frame member 50 of base 12, in combination with a follower-type engagement assembly 120 secured to actuator bar 112.

Retainer plate 118 is formed with a series of notches including a lower notch 122, an intermediate notch 124, and an upper notch 126. Retainer plate 118 also includes an upper angled engagement surface 128 and an upper vertical release surface 130. Retainer plate 118 is formed with a rearwardly facing recess 132, through which actuator bar 112 extends.

Engagement assembly 120 is in the form of a pair of plates 134 located on opposite sides of retainer plate 118. Plates 134 are formed with square openings 135 through which actuator bar 112 extends, so that rotation of actuator bar 112 causes rotation of plates 134. Aligned L-shaped slots 136 are formed in plates 134, and a retainer pin 138 extends through slots 136. Each end of pin 138 is engaged with one end of a spring 140, the opposite end of which is fixed to a spring stay 141 that extends between and outwardly of plates 134. Slots 136 in plates 134 are configured so as to enable pin 138 to move along the forward surface of retainer plate 118 during rotation of actuator bar 112. Pin 138 is selectively engageable with notch 124 to maintain footrest 20 in an angled position, and is engageable with notch 126 to maintain footrest 20 in a fully raised position.

Figure 20:
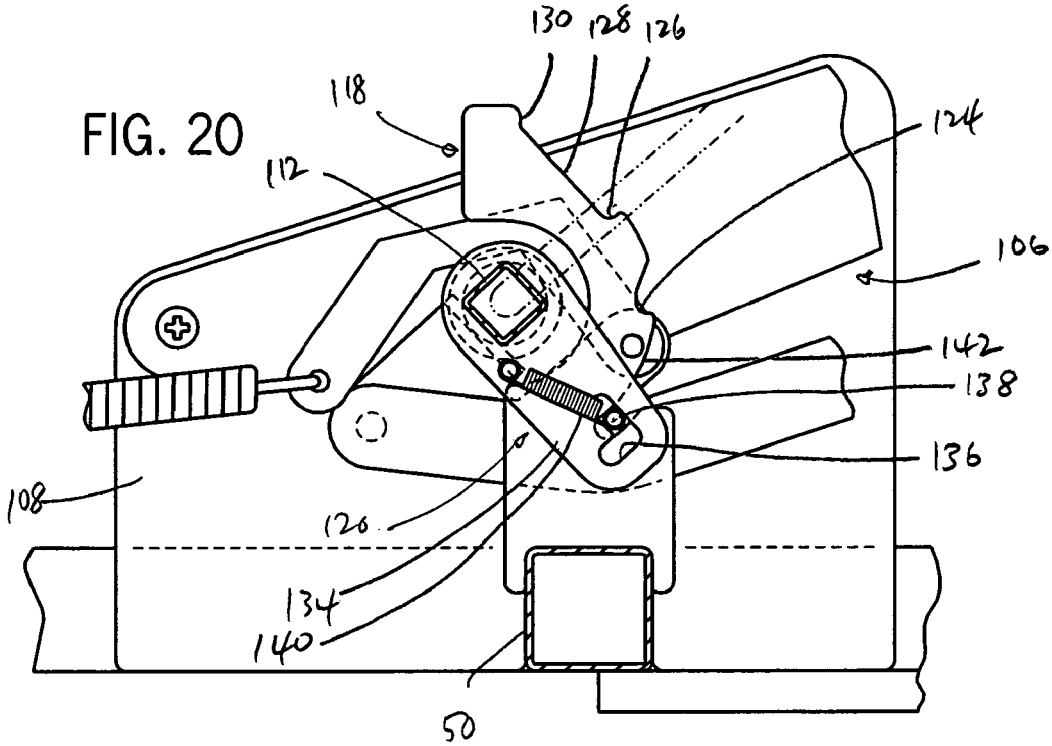
FIG. 20 is an enlarged partial side elevation view, with reference to line 20-20 of FIG. 9, showing the footrest positioning mechanism in a position corresponding to the fully lowered position of the footrest incorporated into the chair of FIG. 1.
Figure 21:
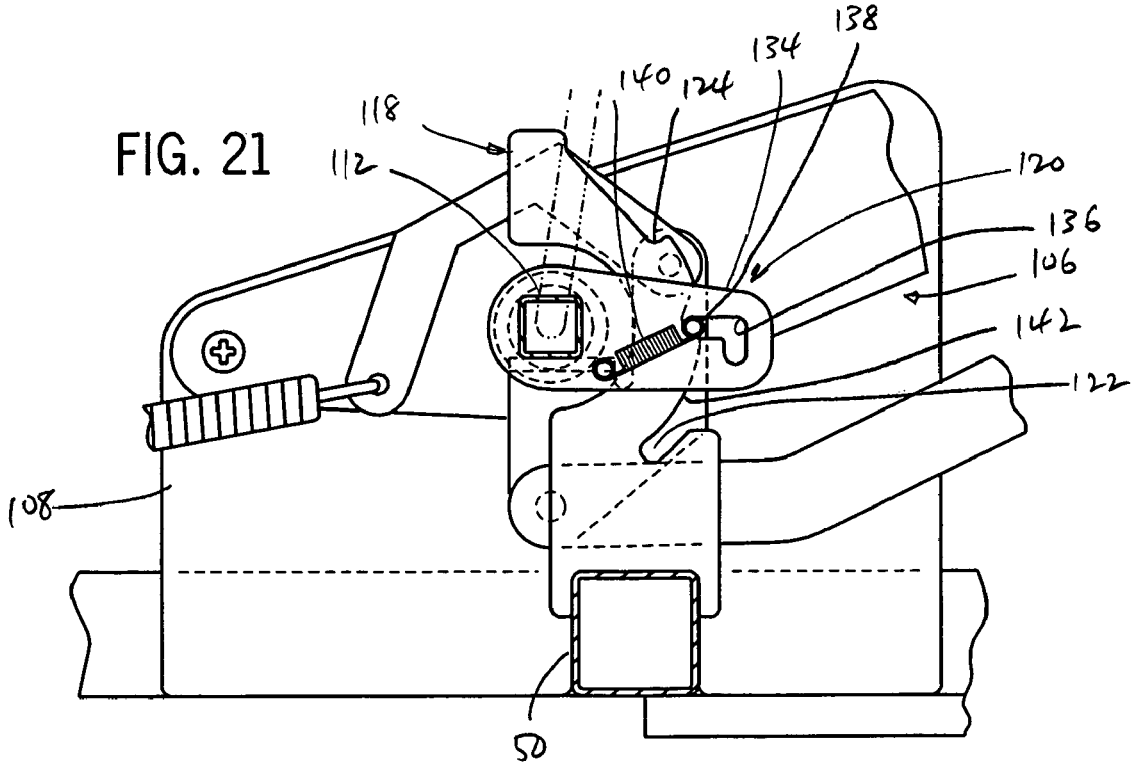
FIG. 21 is a view similar to FIG. 20, showing the footrest positioning mechanism in a position corresponding to a partially raised position of the footrest.
Figure 22:
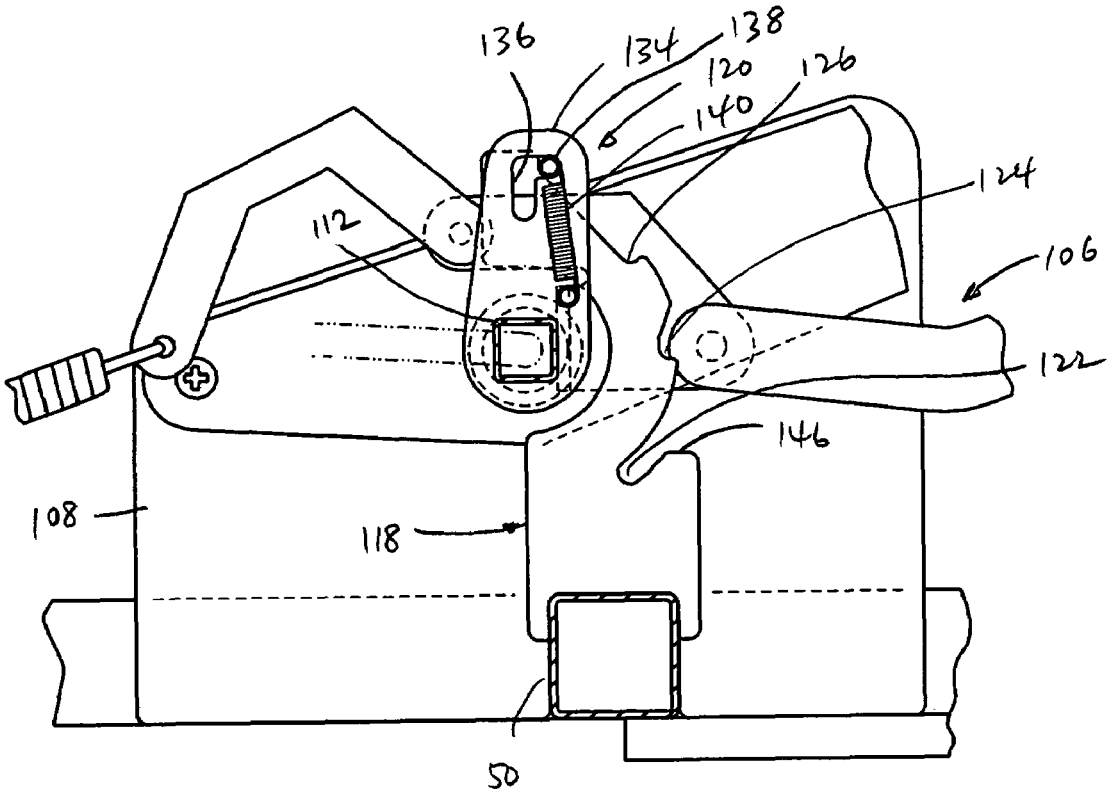
FIG. 22 is a view similar to FIGS. 20 and 21, showing the configuration of the footrest positioning mechanism for providing movement of the footrest from the fully raised position to the lowered position, with reference to line 22-22 of FIG. 12.
Figure 23:
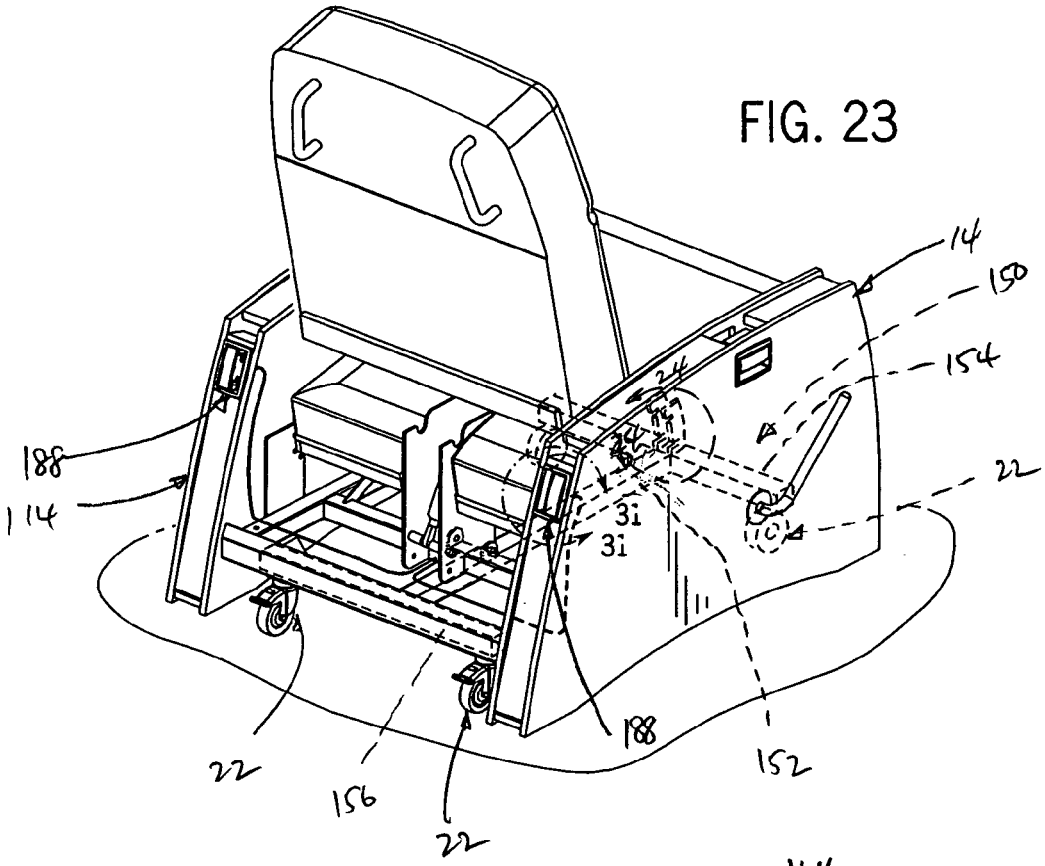
FIG. 23 is a rear isometric view of the chair of FIG. 1, with portions removed to expose the frame and internal components of the chair.
Figure 24:
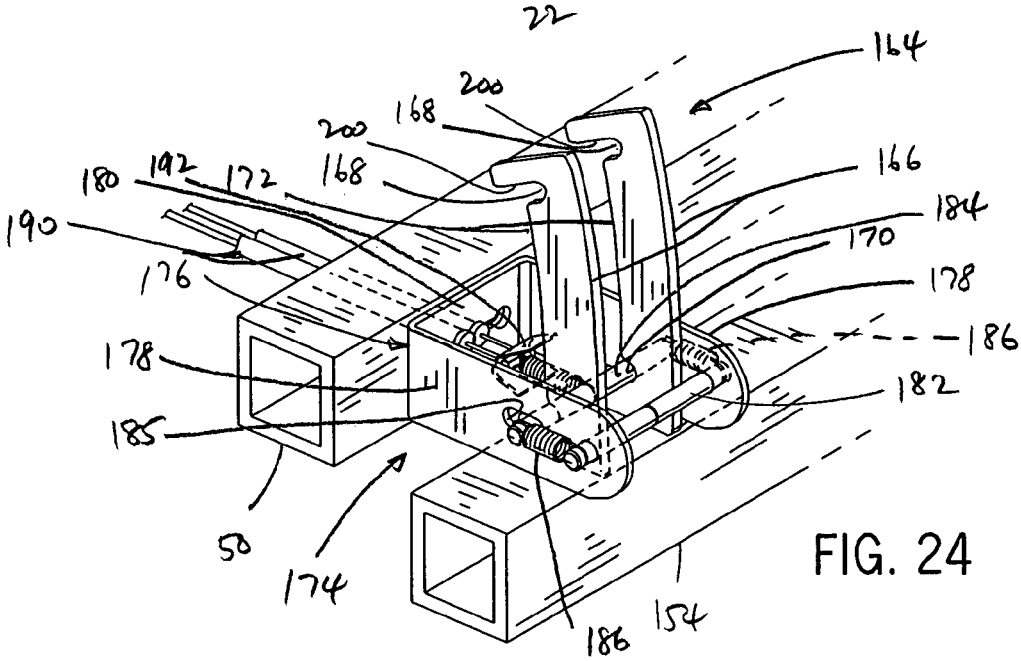
FIG. 24 is a partial isometric view of a Trendelenburg positioning mechanism incorporated into the chair of FIG. 1, with reference to line 24-24 of FIG. 23.
Figure 25:
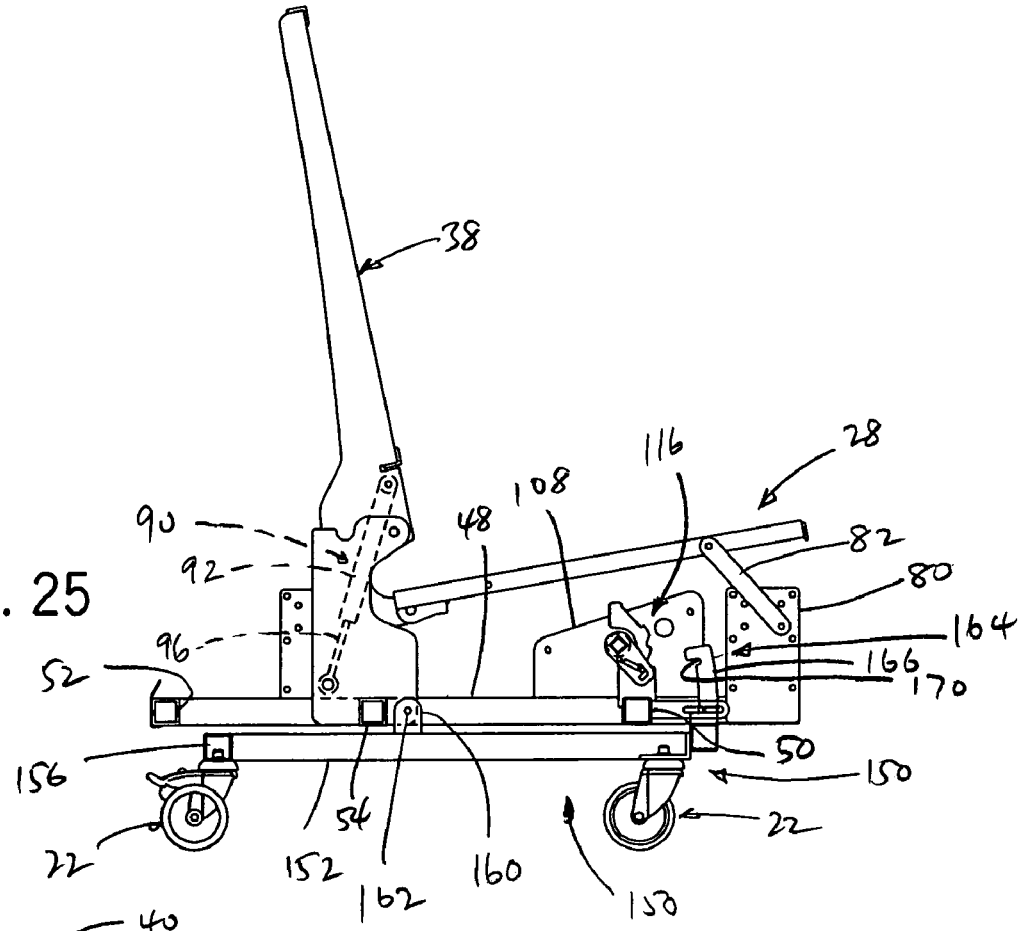
FIG. 25 is a section view taken along line 25-25 of FIG. 8 showing the frame and internal components of the chair in the upright position.
Figure 26:
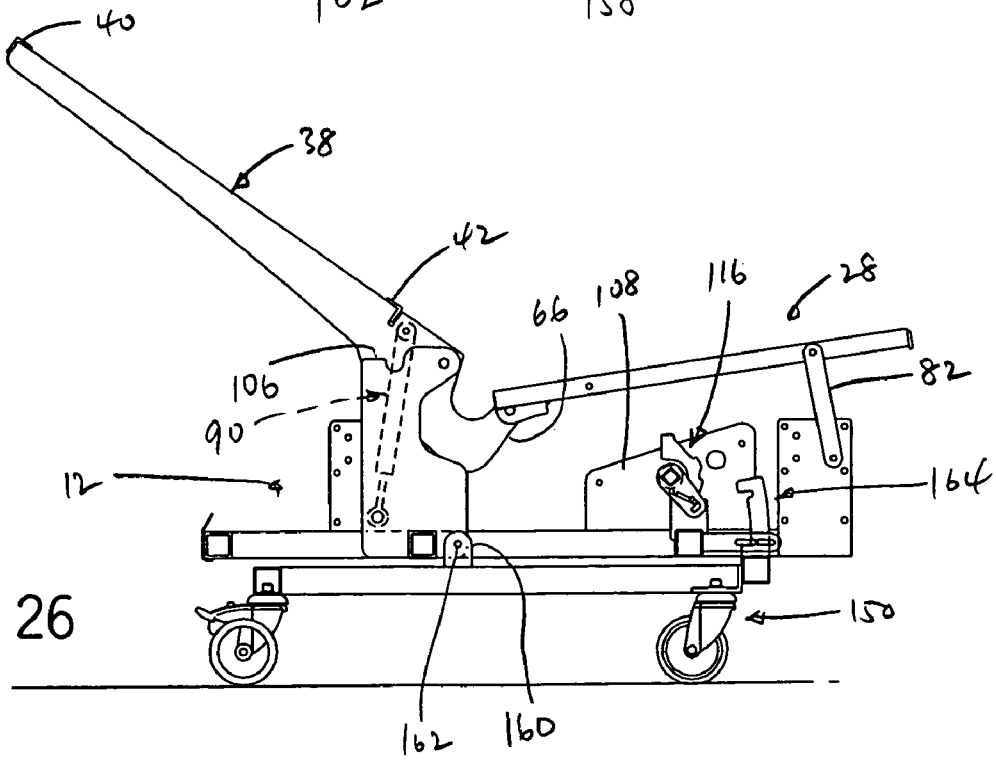
FIG. 26 is a section view similar to FIG. 25, showing the frame and internal components of the chair in a partially reclined position.
Figure 27:
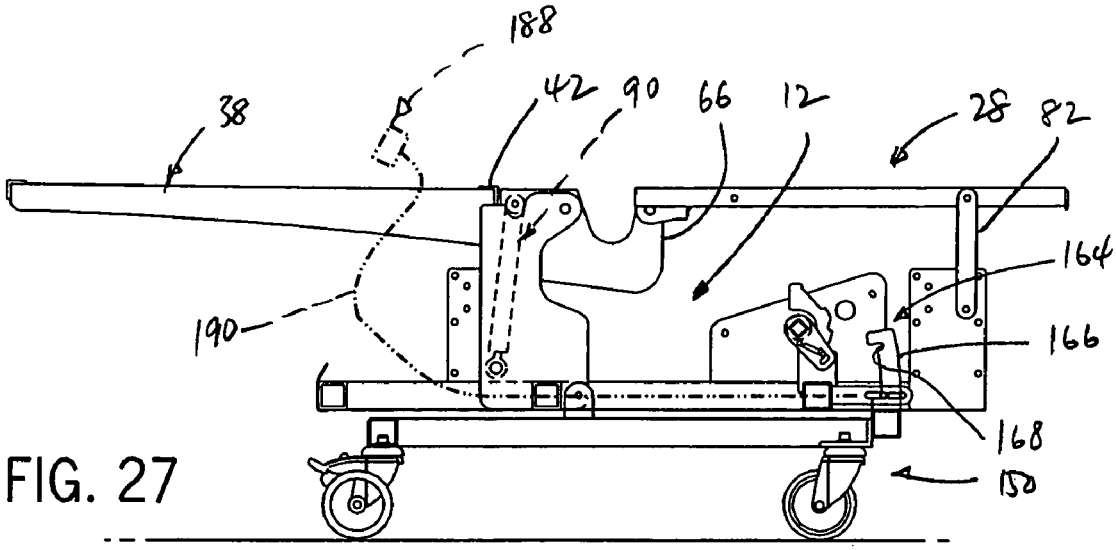
FIG. 27 is a section view similar to FIGS. 25 and 26, showing the frame and internal components of the chair in a fully reclined position.
Figure 28:
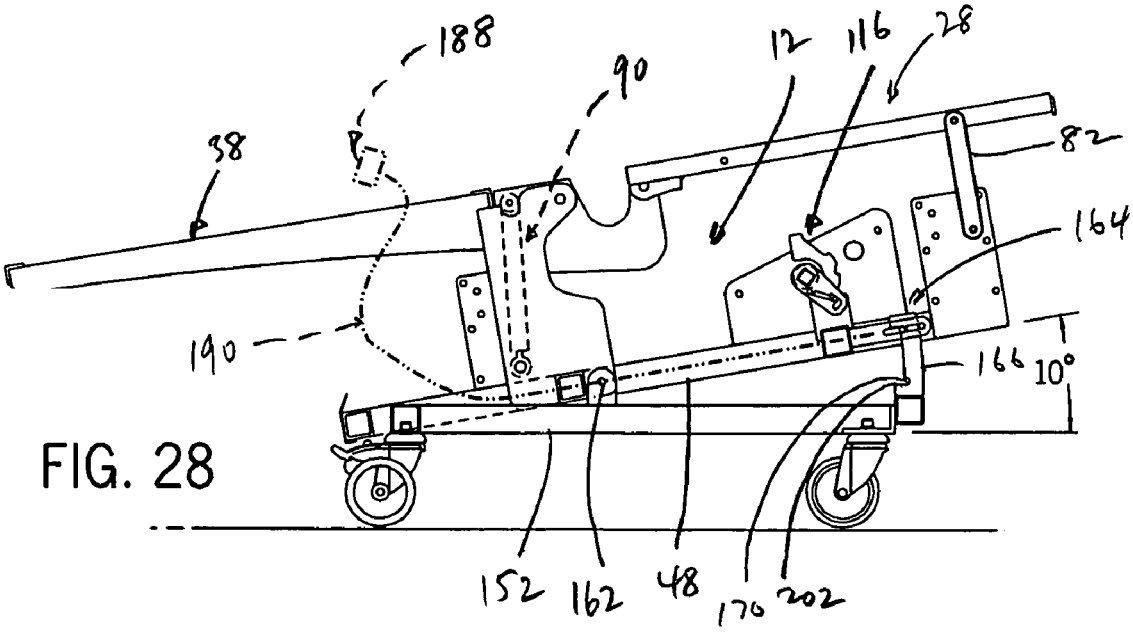
FIG. 28 is a section view similar to FIGS. 25-27, showing the frame and internal components of the chair in a Trendelenburg position.
Figure 29:
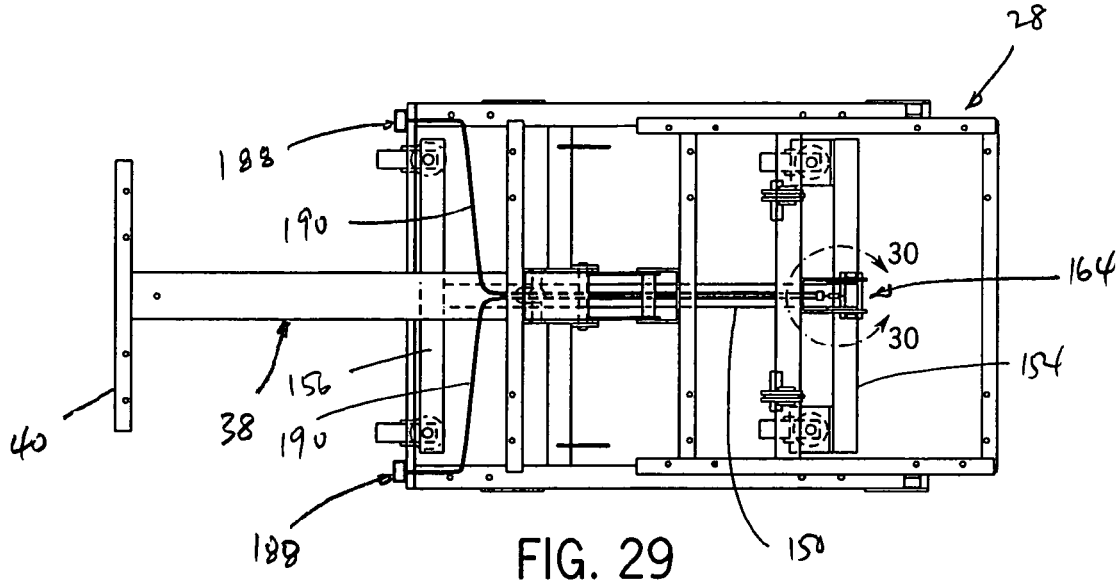
FIG. 29 is a top plan view of the frame and internal components of the chair in the Trendelenburg position of FIG. 28.
Figure 30:
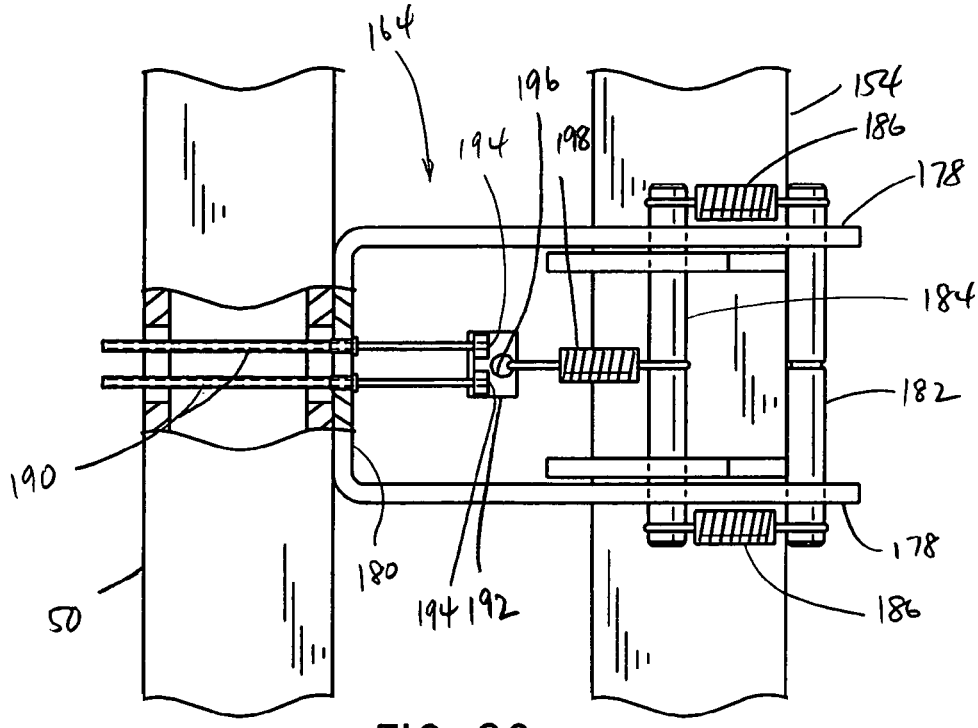
FIG. 30 is an enlarged top plan view, with portions in section, with reference to line 30-30 of FIG. 29.

In operation, footrest positioning mechanism 16 functions as shown in FIGS. 20-22, for selectively maintaining footrest 20 in a desired position. When footrest 20 is in its fully retracted, lowered position as shown in FIG. 20, pin 138 is received within lower notch 122. When it is desired to raise footrest 20, the user applies an upward and rearward force on handle 114, to rotate actuator bar 112 in a counterclockwise direction. Footrest extension and retraction mechanisms 106 function to lift footrest 20 and move footrest 20 outwardly, in a known manner, upon such rotation of actuator bar 112. During such rotational movement of actuator bar 112, pin 138 of engagement assembly 120 rides along the forward surface of retainer plate 118 above lower notch 122, shown at 142. When footrest 20 reaches a predetermined angle in its extension, as shown in FIG. 21, engagement assembly 120 is positioned so that the biasing force on pin 138, applied by springs 140, causes pin 138 to engage within intermediate notch 124. Such engagement of pin 138 within notch 124 maintains footrest 20 in a predetermined angular position, to support the user's feet at an outward angle relative to the seat 16. In the event the user wishes to further elevate and extend footrest 20, the user again applies an upward and rearward force on handle 114 to further rotate actuator bar 112. This rotation of actuator bar 112 and plates 134 lifts pin 138 out of intermediate notch 124 and causes pin 138 to ride along the surface of retainer plate 118 above intermediate notch 124, shown at 144. When it is desired to raise footrest 20 to its uppermost position, in which the surface of footrest 20 is coplanar with the upper surface of seat 16, the user further rotates handle 114 upwardly and rearwardly, to cause additional counterclockwise movement of actuator bar 112 so as to fully extend footrest extension and retraction mechanisms 106. In the fully raised position of footrest 20, engagement assembly 120 is positioned so that the biasing force on pin 138, applied by springs 140, causes pin 138 to engage within upper notch 126 of retainer plate 118. When footrest 20 is in the fully raised position, the upper surface of footrest 20 is coplanar with the upper surface of seat 16. During such rotation of actuator bar 112 and movement of footrest 20, springs 140 maintain pin 138 in engagement with the forwardly facing surface of retainer plate 118. As footrest 20 is raised, pin 138 moves within the axial portions of slots 136 formed in plates 134, which are configured to allow pin 138 to remain in engagement with the forwardly facing surface of retainer plate 118.

When it is desired to lower footrest 20, the user applies an additional force on handle 114 so as to cause additional counterclockwise rotation of actuator bar 112, as shown in FIG. 22. Footrest extension and retraction mechanisms 106 are fully extended, so that such movement does not cause any further movement of footrest 20 beyond its fully extended and raised position. This additional rotation of actuator bar 112 causes rotation of engagement assembly 120 relative to retainer plate 118, which causes pin 138 to move along surface 128 and results in pin 138 coming into contact with release surface 130 defined at the upper end of retainer plate 118. Release surface 130 is oriented so that such rotation of engagement assembly 120 causes pin 138 to move into the outer transverse portions of slots 136 in plates 134. Springs 140 apply a biasing force on pin 138 that maintains pin 138 within the transverse portions of slots 136. When pin 138 is positioned in the transverse portions of slots 136, pin 138 is positioned outwardly of the forwardly facing surface of retainer plate 118 against the biasing force applied to pin 138 by springs 140. The user then applies a forward and downward force on handle 114 to rotate actuator bar 112 in a clockwise direction, which causes footrest 20 to lower and move inwardly toward base 12. Engagement of pin 138 within the outer transverse portions of slots 136 ensures that pin 138 does not engage any of the forwardly facing surfaces of retainer plate 118 during such lowering and retraction of footrest 20. When footrest 20 approaches its fully retracted, lowered position, engagement assembly 120 approaches lower notch 122, which causes pin 138 to come into contact with an upwardly facing actuator surface, shown at 146, defined by retainer plate 118. Actuator surface 146 engages pin 138 as actuator bar 112 and engagement assembly 120 are rotated clockwise, to move pin 138 within the outer transverse portions of slots 136 into alignment with the axial portions of slots 136. As the user continues to lower and retract footrest 20 in this manner, pin 138 reaches a position in which the biasing force of springs 140 moves pin 138 into the axial portions of slots 136, which allows pin 138 to be moved into lower notch 122 so that footrest 20 can be fully lowered and retracted. The above sequence of steps is repeated if it is desired to subsequently raise and lower footrest 20.

While footrest positioning mechanism 116 is shown as having two discrete positions for supporting footrest 20 at certain predetermined angles, it is also contemplated that any additional number of predetermined footrest angles may be accomplished by altering the number and/or positions of the notches in retainer plate 118.

Referring to FIGS. 23-30, chair 10 can be placed in a Trendelenburg position when seat 16 is fully reclined to the flat position in alignment with back 18. To accomplish this, base 12 of chair 10 is pivotably mounted to an H-shaped frame 150, which includes a central axial frame member 152, a front transverse frame member 154 and a rear transverse frame member 156. Chair 10 is movable on a support surface, such as a floor, via casters 22 that are mounted to the ends of front and rear frame members 154, 156, respectively.

Base 12 of chair 10 is pivotably mounted to a pivot bracket 160 of frame 150, so that base 12, including arms 14 as well as seat 16 and back 18, can be pivoted relative to frame 150 from a horizontal position to a reclined Trendelenburg position. Representatively, a pivot bolt 162 may be used to pivotably mount base 12 to pivot bracket 160, for movement about a transverse pivot axis defined by pivot bolt 162.

A latch mechanism 164 is interconnected between frame 150 and base 12, for selectively maintaining base 12 in either a normal, horizontal position or in a reclined, Trendelenburg position. Latch mechanism 164 generally includes a pair of upstanding catch members 166 that are secured to and extend upwardly from front frame member 154. Each catch member 166 includes an upper recess 168 and a lower recess 170. An arcuate edge 172 is located between each upper recess 168 and its associated lower recess 170. Latch mechanism 164 further includes a latch assembly 174 secured to front frame member 50 of base frame 46. Latch assembly 174 includes a mounting bracket 176 having a pair of sidewalls 178 and a mounting wall 180 extending therebetween. Latch assembly 174 is mounted to front frame member 50 via fasteners such as bolts that extend through aligned openings in mounting wall 180 and in the walls of front frame member 50, although it is understood that any other satisfactory mounting arrangement may be employed. A spring stay 182 extends through aligned openings formed in the outer ends of mounting bracket sidewalls 178. A latch pin 184 extends through aligned slots 185 formed in mounting bracket sidewalls 178. A pair of springs 186 extend between the ends of spring stay 182 and latch pin 184, and function to urge latch pin 184 outwardly within slots 185 toward spring stay 182.

Latch pin 184 is movable within slots 185 by operation of one of a pair of Trendelenburg actuators 188, each of which is preferably mounted to the rear of one of arms 14 so as to be readily accessible by a user when it is desired to place chair 10 in the Trendelenburg position. It is understood, however, that a single Trendelenburg actuator may be employed, and that the Trendelenburg actuators may be placed in any satisfactory location on chair 10. In a manner to be explained, each Trendelenburg actuator 188 includes a housing and a movable pull-type actuator member, which is operable to selectively apply tension to a sheathed actuator cable 190, in a manner as is known. Trendelenburg actuators 188 have the same construction and operation as recline actuator 100, the details of which will later be explained.

Each actuator cable 190 is connected at its end opposite actuator 188 with a pull member 192, which has a generally V-shaped configuration. Each actuator cable 190 has a bead 194 or the like at its end, which is received within the trough defined by pull member 192. One leg of pull member 192 includes an opening 196. A spring 198 is engaged at one end within pull member opening 196, and at its opposite end with latch pin 184. Under normal conditions, spring 198 is in a relaxed state and the tension applied by springs 186 forces latch pin 184 outwardly within slots 185, toward spring stay 182.

In assembly, catch members 166 are located between spring stay 182 and latch pin 184. Springs 186 function to bias latch pin 184 against the inner edges of catch members 166. When chair 10 is in the normal, horizontal position, latch pin 84 is engaged within lower recesses 170 of catch members 166. This, in combination with the pivoting mount of base 12 to frame 150, functions to prevent movement of base 12 relative to frame 150, to maintain base 12 in the horizontal orientation.

When it is desired to move chair 10 to a Trendelenburg position, in which seat 16 and back 18 are rearwardly inclined, the user operates one of Trendelenburg actuators 188 so as to apply tension to one of actuator cables 190. Such actuation of either actuator cable 190 functions to draw pull member 192 inwardly, toward mounting wall 180, to apply tension to spring 198. The tension applied to spring 198 overcomes the force of springs 186, so as to move latch pin 184 out of lower recesses 170 in catch members 166, which enables the user to apply a downward force to back 18 so as to pivot base 12 relative to frame 150 about pivot bolt 162. When the Trendelenburg position is attained, latch pin 184 engages a stop surface, shown at 200, defined by each catch member 166. Such engagement of latch pin 184 with stop surfaces 200 limits the rearward pivoting movement of base 12 relative to frame 150. The user then releases Trendelenburg actuator 188 (or actuator 188 may be release as soon as pin 184 clears lower recesses 170) to relieve the tension on actuator cable 190, and springs 186 then move latch pin 184 outwardly into the upper recesses 168 of catch members 166, which functions to positively retain chair 10 in the Trendelenburg position. When it is desired to return chair 10 to the normal position in which base 12 is in a horizontal orientation, the user again operates one of Trendelenburg actuators 188 so as to pull latch pin 184 out of upper recesses 170. This allows the user to pivot base 12 downwardly to the horizontal position. Latch pin 184 then engages lower stop surfaces, shown at 202, defined by catch members 166, for positioning base 12 horizontally relative to frame 50.

Figure 4:
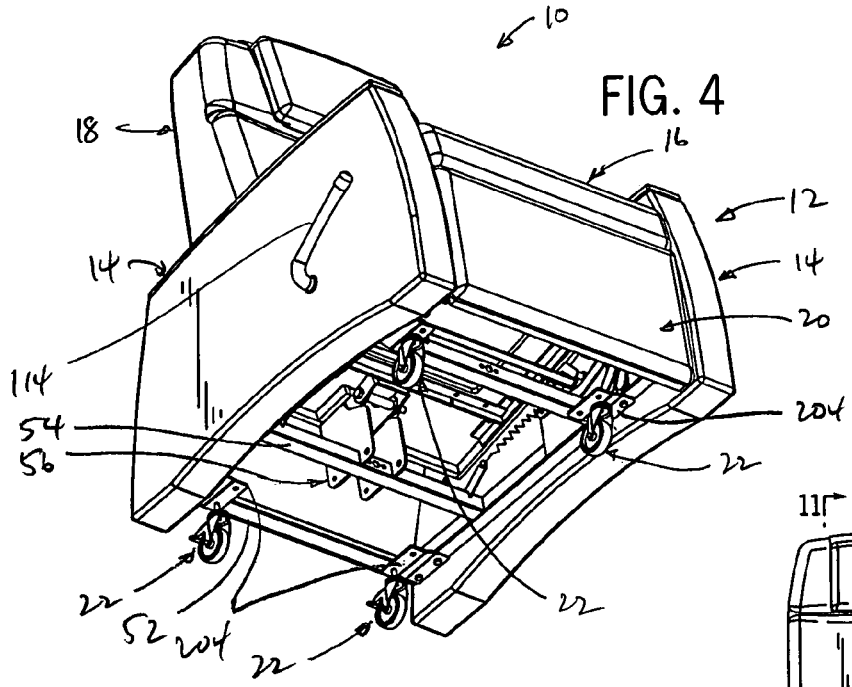
FIG. 4 is a bottom isometric view of the chair of FIG. 1.
Figure 3:
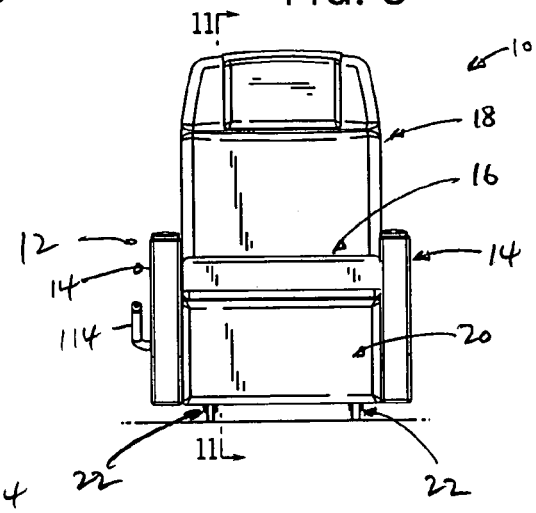
FIG. 3 is a front elevation view of the chair of FIG. 1.
Figure 5:
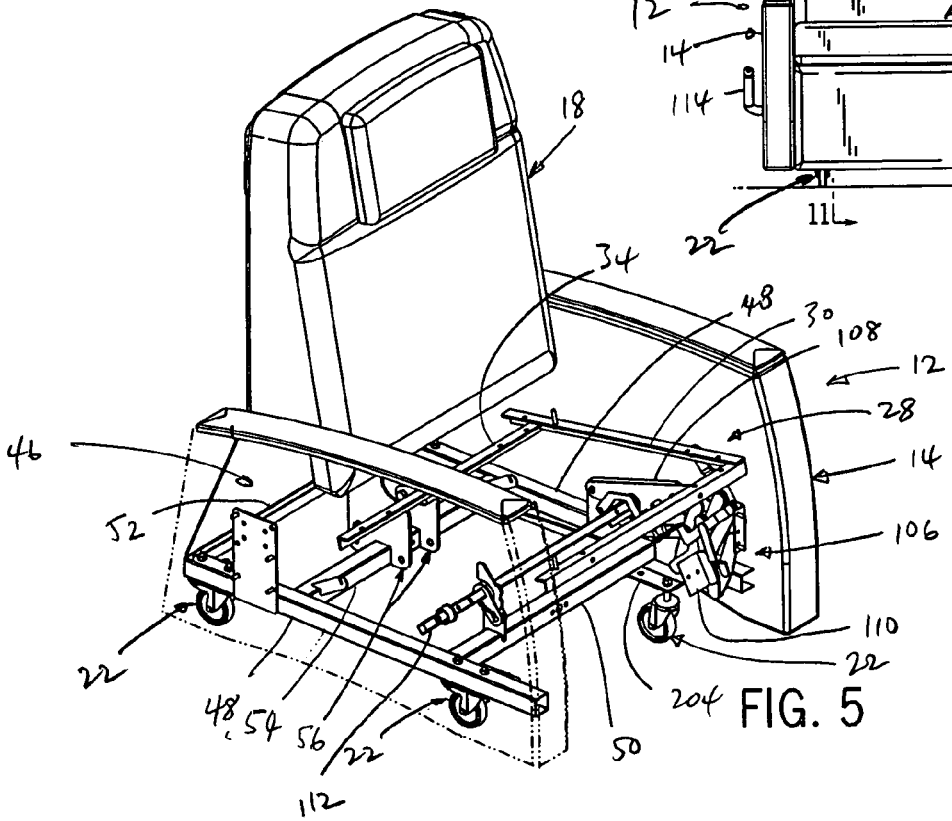
FIG. 5 is an isometric view similar to FIG. 1, with portions removed or broken away to illustrate certain of the internal components of the chair.
Figure 6:
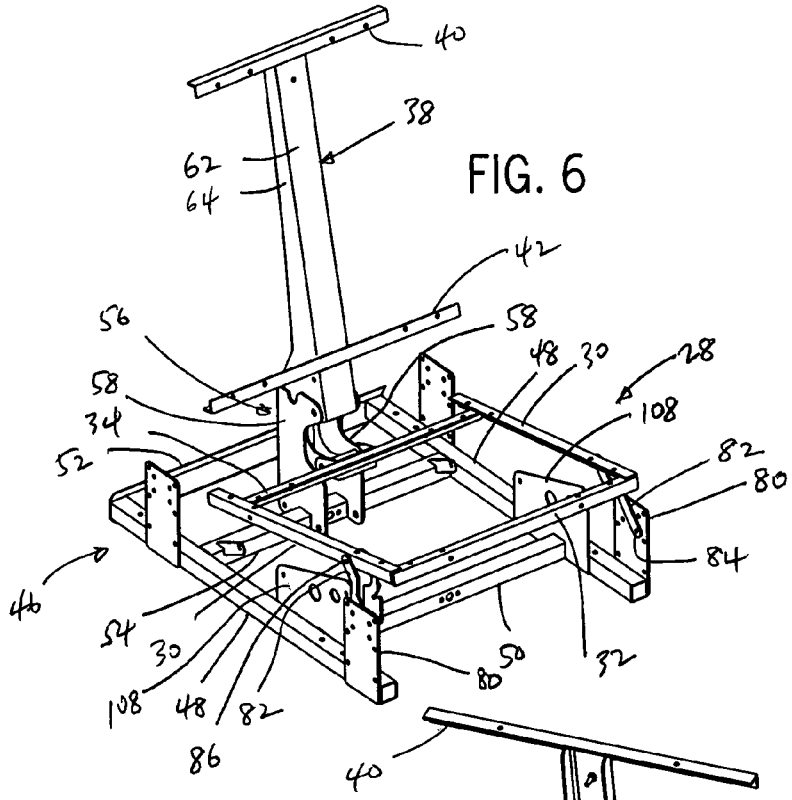
FIG. 6 is a front isometric view of the frame and internal components of the chair of FIG. 1 in a position corresponding to the upright position of the chair as in FIG. 1.
Figure 7:
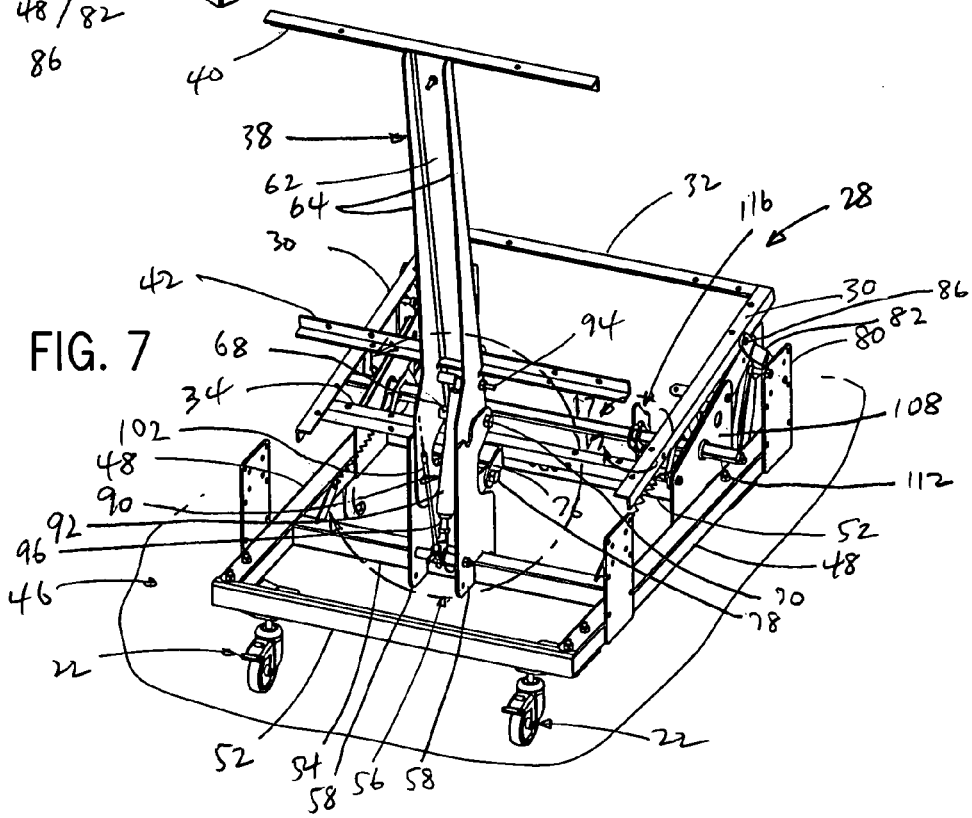
FIG. 7 is a rear isometric view of the frame and internal components of the chair as in FIG. 6.

Chair 10 can be configured to eliminate the Trendelenburg option by eliminating frame 150 and latch mechanism 164, as shown in FIGS. 4 and 5. In this configuration, latch assembly 174 is not mounted to front frame member 50 of base 12. Casters 22, which would otherwise be carried by frame 150, are secured to base 12 by caster mounting brackets 204, which are configured for engagement with side frame members 48 of base 12 and with casters 22.

Figure 31:
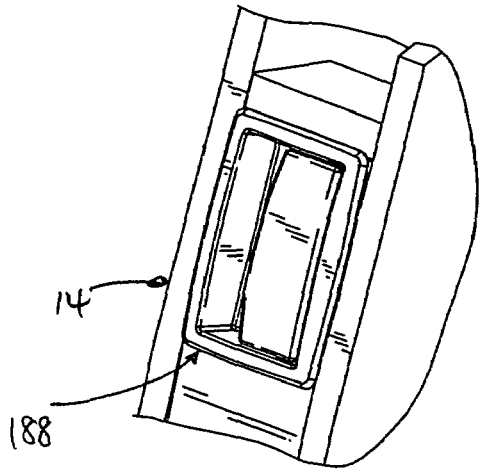
FIG. 31 is a partial isometric view of an actuator incorporated into the chair of FIG. 1, with reference to line 31-31 of FIG. 23.
Figure 33:
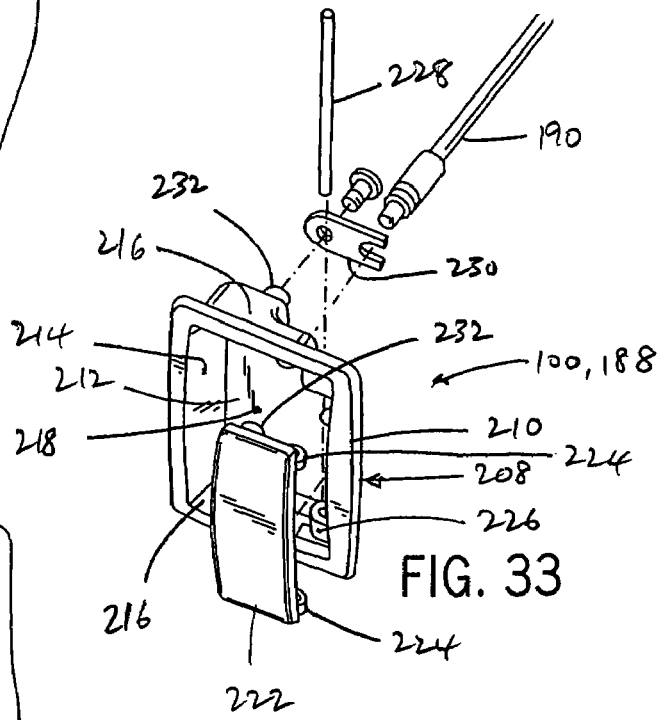
FIG. 33 is an exploded isometric view of the components incorporated in the actuator of FIGS. 31 and 32.
Figure 32:
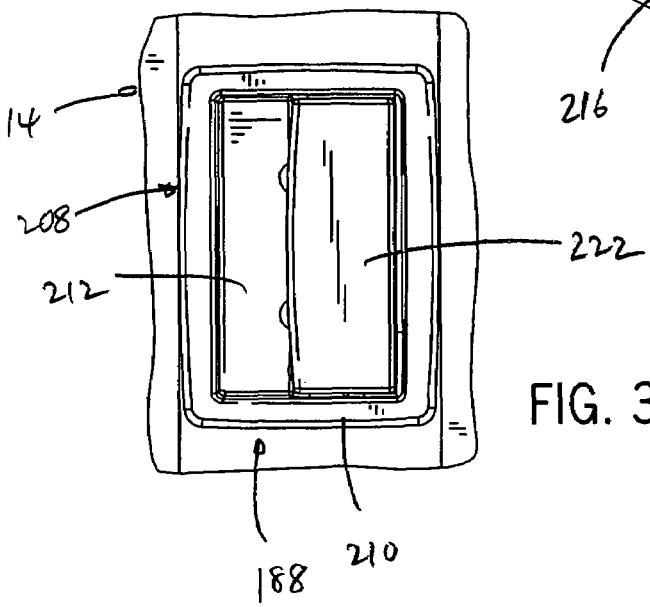
FIG. 32 is an elevation view of the actuator of FIG. 31.

As shown in FIGS. 31-33, each actuator, such as recline actuator 100 and Trendelenburg actuator 188, includes a housing 208 having a peripheral outer rim 210 that surrounds a recess 212 defined by a series of sidewalls including a pair of sidewalls 214 and a pair of end walls 216, in combination with an inner wall 218. An actuator pull 222 is pivotably mounted to housing 208, and overlies a portion of recess 212. The outer edge of actuator pull 222 is spaced above inner housing wall 218, so that a space is defined therebetween. Actuator pull 222 is generally in the form of a wall that overlies a portion of recess 212, so that the area behind actuator pull 222 is empty.

Actuator pull 222 includes a pair of mounting ears 224, each of which is positioned between a pair of mounting lands 226 located on the back of housing 208. A pin or axle 228 extends through aligned openings in mounting ears 224, and engages arcuate recesses in lands 226 for pivotably mounting actuator pull 222 to housing 208.

A strain relief or cable stay 230 is secured to a mounting boss 232, and engages the end of actuator cable 190. The bead at the end of cable 190 extends through an opening in inner wall 218 of housing 208, and is engaged with a bead retainer 232 on the inside surface of cable pull 222.

With the construction of actuator 100, 188 as shown and described, housing 208 can be fitted within a recess formed in a surface of chair 10, and cable pull 222 provides a generally flush mount construction by virtue of the configuration of the outer surface of cable pull 222 being generally flush with the adjacent surfaces of rim 210. The space between the lower edge of cable pull 222 provides easy access for a user's fingers in reaching behind cable pull 222 to apply an outward force to cable pull 222, in order to apply tension to the actuator cable 190.

As can be appreciated, the actuators such as 100, 188 can be positioned in any desired orientation in the structure of chair 10, i.e. either in a horizontal orientation or in a vertical orientation.

In addition, it should be understood that actuators 100, 188 may be used in any other type of application for operating various retainer or latch mechanisms in an article of furniture, providing the virtues of a recessed actuator and an ergonomically satisfactory mechanism for selectively applying tension to an actuator cable.

While the features of the invention have been shown and described in connection with a certain embodiment, it is understood that various alternatives and modifications are contemplated as being within the scope of the present invention. It is also understood that the features of the present invention may be used separately or in various subcombinations.

Various alternatives and embodiments are contemplated as being within the scope of the following claims, which particularly point out and distinctly claim the subject matter regarded as the invention.

We claim:

1. An article of seating furniture, comprising:

a base;

a seat and a back each movably interconnected with the base;

wherein the back includes a frame that is pivotably interconnected with the base for movement between an upright position and a reclined position, and wherein the seat is interconnected with the back frame such that rearward pivoting movement of the back toward the reclined position causes forward and upward motion of the seat, wherein the back is movable to a fully reclined upwardly facing position and the seat is movable to a raised position, and wherein, when the back is in the fully reclined position and the seat is in the raised position, an upper surface of the seat and an upper surface of the back are substantially coplanar;

wherein the back frame defines a lower end which is pivotably interconnected with the base for movement about a back pivot axis, wherein the lower end of the back frame extends upwardly from the back pivot axis when the back is in the upright position, and wherein the back frame further includes a seat mounting extension in a fixed angular relationship relative to the lower end of the back frame, wherein the seat mounting extension of the back frame extends downwardly below the back pivot axis when the back is in the upright position, wherein a rearward area of the seat is pivotably mounted to the seat mounting extension of the back frame; and a mounting link arrangement interposed between a forward area of the seat and the base;

wherein rearward movement of the back from the upright position toward the reclined position causes the seat mounting extension of the back frame to move upwardly to lift the rearward area of the seat, and wherein the mounting link arrangement is configured to provide forward movement of the seat when the back is moved from the upright position toward the reclined position.

2. The article of seating furniture of claim 1, further comprising a footrest interconnected with the base for movement between a retracted position and an extended position, wherein the footrest in the extended position is generally coplanar with the seat.

3. The article of seating furniture of claim 2, wherein the base defines a transversely central area, and wherein, when the back is in the fully reclined upwardly facing position, the seat is in the raised position and the footrest is in the extended position, a central area defined by the back, the seat and the footrest are generally aligned with the transversely central area of the base.

4. The article of seating furniture of claim 1, further comprising a biased cylinder arrangement interconnected with one or more manually operable reclining actuators mounted to the article of seating furniture, wherein the biased cylinder arrangement is interconnected between the back frame and the base.

5. The article of seating furniture of claim 1, further comprising a frame engaged with a support surface such as a floor, wherein the base is pivotably mounted to the frame for movement between a generally horizontal orientation and a Trendelenburg orientation in which a head area of the back is lowered relative to the seat.

6. The article of seating furniture of claim 5, including a latch arrangement interposed between the frame and the base for selectively maintaining the base in either the generally horizontal orientation or in the Trendelenburg orientation.

7. The article of seating furniture of claim 6, wherein the latch arrangement includes a retainer member including first and second engagement areas, and a latch member that is selectively engageable with one of the first and second engagement areas for releasably maintaining the base in either the generally horizontal orientation or in the Trendelenburg orientation.

8. The article of seating furniture of claim 1, wherein the back includes a back frame having a central spine member pivotably interconnected with the base, wherein the central spine member is located in a longitudinally central area of the back.

9. The article of seating furniture of claim 1, further comprising a frame engaged with a support surface such as a floor, wherein the base is pivotably mounted to the frame for movement between a generally horizontal orientation and a Trendelenburg orientation in which a head area of the back is lowered relative to the seat.

10. The article of seating furniture of claim 9, including a latch arrangement interposed between the frame and the base for selectively maintaining the base in either the generally horizontal orientation or in the Trendelenburg orientation.

11. An article of seating furniture, comprising:

a base;

a seat and a back mounted to the base, wherein the back is mounted to the base via a back reclining mechanism and wherein the seat is interconnected with the back reclining mechanism such that rearward reclining motion of the back causes forward and upward motion of the seat, wherein the back is movable to a fully reclined upwardly facing position and the seat is movable to a raised position, and wherein, when the back is in the fully reclined position and the seat is in the raised position, an upper surface of the seat and an upper surface of the back are substantially coplanar;

a pair of arms, wherein a first one of the arms is located on a first side of the seat and a second one of the arms is located on a second side of the seat, wherein each arm defines a forward area and a rearward area;

a frame engaged with a support surface such as a floor, wherein the base is pivotably mounted to the frame for movement between a generally horizontal orientation and a Trendelenburg orientation in which a head area of the back is lowered relative to the seat;

a latch arrangement interposed between the frame and the base for selectively maintaining the base in either the generally horizontal orientation or in the Trendelenburg orientation, wherein the latch arrangement includes a single retainer member including first and second engagement areas, and a single latch member that is selectively engageable with one of the first and second engagement areas for releasably maintaining the base in either the generally horizontal orientation or in the Trendelenburg orientation, wherein the latch member is movable between a latching position in which the latch member is engaged with one of the first and second engagement areas of the retainer member, and a release position in which the latch member is disengaged from both the first and second engagement areas; and a pair of Trendelenburg position actuators mounted to the article of seating furniture, wherein a first one of the Trendelenburg position actuators is mounted to the rearward area of the first arm and wherein a second one of the Trendelenburg position actuators is mounted to the rearward area of the second arm, and wherein the latch member is movable to the release position in response to operation of either of the pair of Trendelenburg position actuators.

12. The article of seating furniture of claim 11, wherein each Trendelenburg position actuator comprises a cable-type actuator including a cable having an outer end interconnected with a manually operated actuation member, and an inner end interconnected with the latch member via a movable operating member, wherein the operating member is operable to move the latch member to the release position in response to movement of the inner end of the cable of either of the cable-type actuators.

13. The article of seating furniture of claim 12, further comprising biasing means for biasing the latch member toward the latching position, and wherein the operating member is configured to move the latch member to the release position against a biasing force exerted by the biasing means.

14. The article of seating furniture of claim 11, wherein the base includes a pair of arms located one on either side of the seat, wherein each arm defines a forward area and a rearward area located adjacent the back when the back is in an upright position, and wherein each Trendelenburg position actuator is mounted to the rearward area of one of the arms.

15. A method of altering the configuration of an article of seating furniture having a base, and a seat and a back mounted to the base, comprising the acts of:

reclining the back relative to the seat from an upright position to a fully reclined position in which an upper surface of the back faces upwardly; and moving the seat forwardly and upwardly in response to reclining movement of the back from the upright position to the fully reclined position and wherein, when the back is in the fully reclined position, the seat is in a raised position in which an upper surface of the seat and the upper surface of the back are substantially coplanar;

wherein the act of moving the back between the upright position and the fully reclined position is carried out by movement of a frame member that defines a lower end which is pivotably interconnected with the base for movement about a back pivot axis, wherein the lower end of the back frame member extends upwardly from the back pivot axis when the back is in the upright position, wherein the frame member includes a seat mounting extension in a fixed angular relationship relative to the lower end of the back frame member, wherein the seat mounting extension extends downwardly below the back pivot axis when the back is in the upright position, wherein a rearward area of the seat is pivotably mounted to the seat mounting extension of the frame member, wherein rearward movement of the back from the upright position toward the reclined position causes the seat mounting extension of the back frame to move upwardly to lift the rearward area of the seat, and further comprising the act of moving the seat relative to the base via a mounting link arrangement interposed between a forward area of the seat and the base for providing forward and upward movement of the seat when the back is reclined in response to rearward movement of the back from the upright position toward the reclined position.

16. The method of claim 15, further comprising the act of moving a footrest interconnected with the base between a retracted position and an extended position, wherein the footrest in the extended position defines an upwardly facing surface that is generally coplanar with the upwardly facing surfaces of the seat and the back.

17. The method of claim 16, wherein the base defines a central area, and wherein, when the back is in the fully reclined upwardly facing position and the seat is in the raised position and the footrest is in the extended position, a longitudinal center defined by the back, the seat and the footrest are generally aligned with the central area of the base.

18. The method of claim 15, wherein the act of moving the back between the upright position and the fully reclined position is carried out by operation of a biased cylinder arrangement interconnected with one or more manually operable reclining actuators mounted to the article of seating furniture, wherein the biased cylinder arrangement is interconnected between the frame member and the base.

19. The method of claim 15, further comprising the act of selectively pivoting the base between a generally horizontal orientation and a Trendelenburg orientation in which a head area of the back is lowered relative to the seat.

20. The method of claim 19, including the act of selectively maintaining the base in either the generally horizontal orientation or in the Trendelenburg orientation by operation of a latch arrangement interposed between the base and a frame to which the base is pivotably mounted.

21. The method of claim 20, wherein the latch arrangement includes a retainer member including first and second engagement areas, and further comprising the act of selectively engaging a latch member with one of the first and second engagement areas for releasably maintaining the base in either the generally horizontal orientation or in the Trendelenburg orientation.

* * * * *